US010051373B2

(12) United States Patent
Stahl et al.

(10) Patent No.: US 10,051,373 B2
(45) Date of Patent: Aug. 14, 2018

(54) AUDIO TRANSDUCER WITH HYBRID DIAPHRAGM

(71) Applicants: Alexander Manly Stahl, Santa Paula, CA (US); Patricia Hays Clemens, Santa Paula, CA (US); John Devecka, Westlake Village, CA (US)

(72) Inventors: Alexander Manly Stahl, Santa Paula, CA (US); Patricia Hays Clemens, Santa Paula, CA (US); John Devecka, Westlake Village, CA (US)

( * ) Notice: Subject to any disclaimer, the term of this patent is extended or adjusted under 35 U.S.C. 154(b) by 0 days.

(21) Appl. No.: 15/170,698

(22) Filed: Jun. 1, 2016

(65) Prior Publication Data

US 2016/0353206 A1 Dec. 1, 2016

Related U.S. Application Data

(60) Provisional application No. 62/169,486, filed on Jun. 1, 2015.

(51) Int. Cl.

| | |
|---|---|
| ***H04R 1/00*** | (2006.01) |
| ***H04R 7/04*** | (2006.01) |
| ***H04R 5/02*** | (2006.01) |
| ***H04R 1/02*** | (2006.01) |
| ***F21V 33/00*** | (2006.01) |
| ***F21S 6/00*** | (2006.01) |
| ***H04R 7/02*** | (2006.01) |
| *H04S 1/00* | (2006.01) |

(52) U.S. Cl.

CPC ..... *H04R 7/04* (2013.01); *F21S 6/002* (2013.01); *F21V 33/0056* (2013.01); *H04R 1/028* (2013.01); *H04R 5/02* (2013.01); *H04R 7/02* (2013.01); *H04R 7/045* (2013.01); *H04S 1/002* (2013.01)

(58) Field of Classification Search

CPC ... H04R 7/04; H04R 5/02; H04R 7/16; H04R 1/028; H04R 7/02; H04R 7/045; H04S 1/002; H04S 7/00; H04S 2420/01

USPC ..... 381/300, 306, 423, 426, 431, 162–163, 381/191

See application file for complete search history.

(56) References Cited

U.S. PATENT DOCUMENTS

| | | | | |
|---|---|---|---|---|
| 5,115,472 | A * | 5/1992 | Park | H04R 1/028 310/324 |
| 6,044,159 | A * | 3/2000 | Schmertmann | H04R 7/04 381/186 |
| 8,073,162 | B2 * | 12/2011 | Ando | H04R 1/403 381/152 |
| 8,528,264 | B1 * | 9/2013 | Thut | F16M 13/02 52/27 |
| 2005/0053257 | A1 * | 3/2005 | Johnson | H04R 7/04 381/431 |

(Continued)

*Primary Examiner* — Disler Paul
(74) *Attorney, Agent, or Firm* — Kolisch Hartwell, P.C.

(57) ABSTRACT

Systems for generating audible sound, including one or more elongate rods attached to one or more flexible membranes, such that longitudinal vibrations of the rods cause vibrations of the membranes, thereby producing audible sound. In some cases, an input audio signal may cause an electromotive actuator to vibrate, and the actuator may be coupled to one of the elongate rods. In some cases, one actuator may be provided for each elongate rod. In some cases, each actuator may receive a different channel of a multi-channel audio signal, such as a stereo signal.

14 Claims, 23 Drawing Sheets

Active Analog 2.1 System

(56) References Cited

U.S. PATENT DOCUMENTS

| | | | | |
|---|---|---|---|---|
| 2009/0123000 | A1* | 5/2009 | Wright | H04R 1/105<br>381/59 |
| 2009/0169047 | A1* | 7/2009 | Ando | H04R 1/403<br>381/396 |
| 2013/0287241 | A1* | 10/2013 | Prelogar | H04R 1/105<br>381/381 |
| 2014/0270327 | A1* | 9/2014 | Hedges | H04R 7/18<br>381/398 |

* cited by examiner

Passive Stereo System

Passive Stereo System, Single Membrane

Passive Stereo System with Tweeters

Active Analog 2.1 System

Full-featured Stereo System

Full-featured 2.1 System

Stabilizer and Coupler Detail

Adjustable Diaphragm Curvature

Sound Sail Front Elevation and Perspective View

Sound Sail Right Elevation and Top Plan View

Sound Sail Exploded Perspective View

Sound Spiral Front Elevation and Perspective View

Sound Spiral Right Elevation and Top Plan View

Sound Spiral Bottom Plan View and Side Perspective View

Sound Spiral, Wall Mounted Pair, Front Elevation View

Sound Spiral, Ceiling Mounted, Perspective View

Large Sound Spiral, Ceiling Mounted Array, Perspective View

Large Sound Spiral, Floor Standing Pair, Front Perspective View

Sound Sail, Fan Style Diaphragm
Front Elevation and Perspective View

Sound Sail, Diamond Style Diaphragm
Front Elevation and Perspective View

Sound Sail, Shield Style Diaphragm
Front Elevation and Perspective View

Sound Sail, Cello Style Diaphragm
Front Elevation and Perspective View

Sound Sail, Electric Guitar Style Diaphragm
Front Elevation and Perspective View

AUDIO TRANSDUCER WITH HYBRID DIAPHRAGM

CROSS-REFERENCE TO RELATED APPLICATION

This application claims priority from U.S. Provisional Patent Application Ser. No. 62/169,486, filed Jun. 1, 2015, all of which is hereby incorporated by reference.

BACKGROUND

Audio loudspeakers are ubiquitous in homes, offices and outdoor spaces throughout the world. Conventional audio speakers typically use transducers that act as pistons, and strive to be point sources of sound. However, conventional audio speakers are most commonly rectangular boxes, which often do not fit into the decor of the home or other environment of the speaker. Partly for this reason, more planar speaker designs have been introduced. However, even though some planar speaker designs exist, these existing planar speakers are typically fragile, expensive and lack good low frequency response.

One example of a known planar speaker design includes edge-driven, curved panel speakers where the sound originates in "flextensional" sonar transducers that are designed to resonate at ultrasonic frequencies. However, speakers of this type typically lack wideband frequency response. Furthermore, existing edge-driven speakers intended to produce wideband audible signals have limitations due to uniform diaphragm construction, fragile materials, and high costs of production.

For the reasons above, there is a need for improved audio speaker designs with more aesthetic flexibility than traditional, box-like speakers and improved sound quality relative to existing edge-driven speakers.

SUMMARY

The present disclosure relates to the field of acoustic transducers, as applied to wide frequency range application such as music, voice and multimedia entertainment. Specifically, the present disclosure relates to sound production involving a novel hybrid diaphragm with optimized mechanical properties.

The present disclosure also relates to the fields of interior and industrial design, in that it allows loudspeakers to be constructed with new forms of inherent visual beauty and functional aesthetics. This specifically includes an integrated lighting and sound fixture, where a sculptural panel serves as both lampshade and dual sided acoustic radiator. Speakers according to aspects of the present disclosure also support user-replaceable and arch adjusting diaphragms to offer alternate output tone and feature a variety of different shapes, colors, and materials.

Additional technical improvements described in certain embodiments of the present teachings include optimized voice-coil actuator coupling, integration of the actuator and diaphragm into a unified construction, and novel signal processing for multiple-actuator configurations.

Sections A-D below further summarize features of various embodiments according to the present teachings.

A. Hybrid Diaphragms

An acoustic transducer using a hybrid diaphragm comprised of one or more relatively stiff rods, coupled lengthwise to one or more flexible membranes. The rods and membrane are produced with complementary mechanical properties tuned to work together and provide novel improvements in acoustical qualities.

Specific features of the diaphragm, including aspects of its material composition, structure and shape, and driver coupling act to improve spatial coherency in fundamental frequency ranges of interest to music and voice reproduction applications. This is an improvement over many forms of prior loudspeaker art, that often have undesirable sound coloration due to panel or cabinet resonances, crossover phase distortion, single directional sound projection, limited sound projection surface area and spatial lobes.

Structurally, the rod(s) generally possess relatively high density, high elastic moduli, and low internal scattering of vibration. Preferred embodiments employ rod material with long unidirectional fibers such as bamboo, vertical grain wood, fiberglass or carbon fiber composites.

The rods are longitudinally actuated along their length by an electromotive actuator such as a voice coil or other similar device.

The rod, in a straight form without significant curvature, conducts acoustic energy along its length in a predominately linear, unidirectional manner, with minimal radial losses. In this sense the rod acts similar to an optical fiber for data transmission Deviations in straightness (e.g. curvature or angles) in the rod(s) and/or deviations from planar flatness in the membrane(s) (e.g. curvature, twists and/or pleats) cause conversion of longitudinal waves in the solid materials into transverse flexural wave, that are then coupled to the air and create audible sound.

The rod is made so that the speed of sound along its length is substantially greater than the speed of sound in air. Therefore at a given frequency, the wavelength in the panel is substantially greater than the corresponding wavelength in air. Particularly for wavelengths exceeding the panel dimensions, this results in fewer ripples in the transverse vibration of the diaphragm, and hence a more uniformly projected wavefront of audible sound.

The membrane(s) have generally lower density, moderate elastic moduli, and greater internal diffusion and scattering of vibration. This reduces boundary reflections, standing waves and the strength of resonant peaks in the panel, and provides improved coupling or improved acoustical impedance matching the air. Transverse waves (flexural bending waves) tend to decay or diffuse within the membrane, in some cases approaching evanescent waves in directions orthogonal to the actuation axis (or axes).

These effects are particularly relevant in musically important frequency ranges, helping to avoid sound coloration that may distract the listener's perception of natural resonances in audio content, e.g. vocal formants. This technique also provides a novel spatial radiation pattern, which has been shown to have an appealing and natural psychoacoustic quality. In addition, sound is dispersed on both sides of the surface with the A & B surface producing sound. In the embodiment of a curved surface, A & B surface could project a different tone or EQ shape.

B. Membranes Attached at a Distance

An acoustic transducer of the above general type, where the membrane may be attached to the rod at a significant distance from the actuator (from a few centimeters to over a meter in some embodiments), provided that the rod segment between the actuator and membrane is nominally straight. This novel embodiment provides new functional and aesthetic possibilities for loudspeakers, including lightweight, free hanging panels with no visible drivers, lampshades that are also speaker diaphragms, and numerous other significant innovations. These speakers appear and perform as "lights" to a viewer. Multiple speakers can be musically linked and combined together in identical or different sizes and shapes and configurations to produce certain desired tonal qualities to authentically produce the various frequencies zones in a musical work. In some cases, different musical stems or frequencies can be directed to certain speakers to optimize the sound quality of the array of speakers.

C. Acoustic Panels with Artistic Design Features

An acoustic transducer of the above general type where the primary acoustic radiation surface, has inherent and/or applied artistic design features. Thus the current invention offers consolidation of 2 devices and thus provides enhanced visual appeal and usage of available space, in addition to its acoustical utility. Applications include using the acoustic panel as an integral functional component of a lighting fixture, e.g. a diffusing lampshade, directional light reflector, a fan blade or visual projection surface that directly emits high-quality sound. Visual aesthetic enhancements specifically include construction featuring exposed natural materials such as handmade paper, bamboo, and wood veneer, and/or the application of patterns, imagery or text to the panel surface via paint, printing techniques, laser etching, or other known materials and methods.

The hybrid diaphragm, due to the fact that it is coupled to the actuator at a single point by a simple rigid rod, may also be easily made removable and replaceable. This further expands the invention's ability to provide numerous aesthetic and functional design variations within the scope of a single product. The user can select from various interchangeable "shade" designs which are mutually speaker diaphragms.

Thus one or a small number of actuator housings may be efficiently mass-produced, and offered with any of a wide range of hybrid diaphragm shapes and styles, to create a product line that is efficiently adaptable to a wide variety of personal tastes and application criteria. This serves to inexpensively support a variety of decorative styles; limited edition, or custom art; and changes in individual preferences such as seasonal or holiday themed or sized redecoration, DIY color-your-own diaphragm panels or designed via a website or app design program, or for special events. Furthermore the panels are engineered for low cost and easy replacement to allow for greater product longevity and simplified repair in the event of damage.

D. Multiple Actuators

An acoustic transducer of the above general type employing multiple actuators that work together to further improve the perceived sound quality of the transducer. For example actuators may be attached to both ends of a rod, driving it in opposition. Additional signal processing applied separately to each actuator's drive signal may be employed to further these improvements. For example frequency dependent phase shifts between the drive signals may be used to reduce internal reflections in the hybrid diaphragm and improve transient response. Multiple diaphragms may be coupled to a single transducer to provide different tone or more sound projection surface.

BRIEF DESCRIPTION OF THE DRAWINGS

FIGS. 37*a*-37*c*, is a schematic mechanical representation of a rod stabilizer and coupler according to aspects of the present teachings. FIG. 37*a* is an exploded view showing individual components separately. FIG. 37*b* shows the actuator and rod halves assembled but not coupled. FIG. 37*c* shows the complete assembly with rod and actuator coupled.

DETAILED DESCRIPTION

I. General Principles and Schematic Depictions

This section describes general principles of operation of audio transducers, and the corresponding drawings depict various embodiments of such transducers schematically, according to aspects of the present teachings; see FIGS. 1-8.

Figure 1:
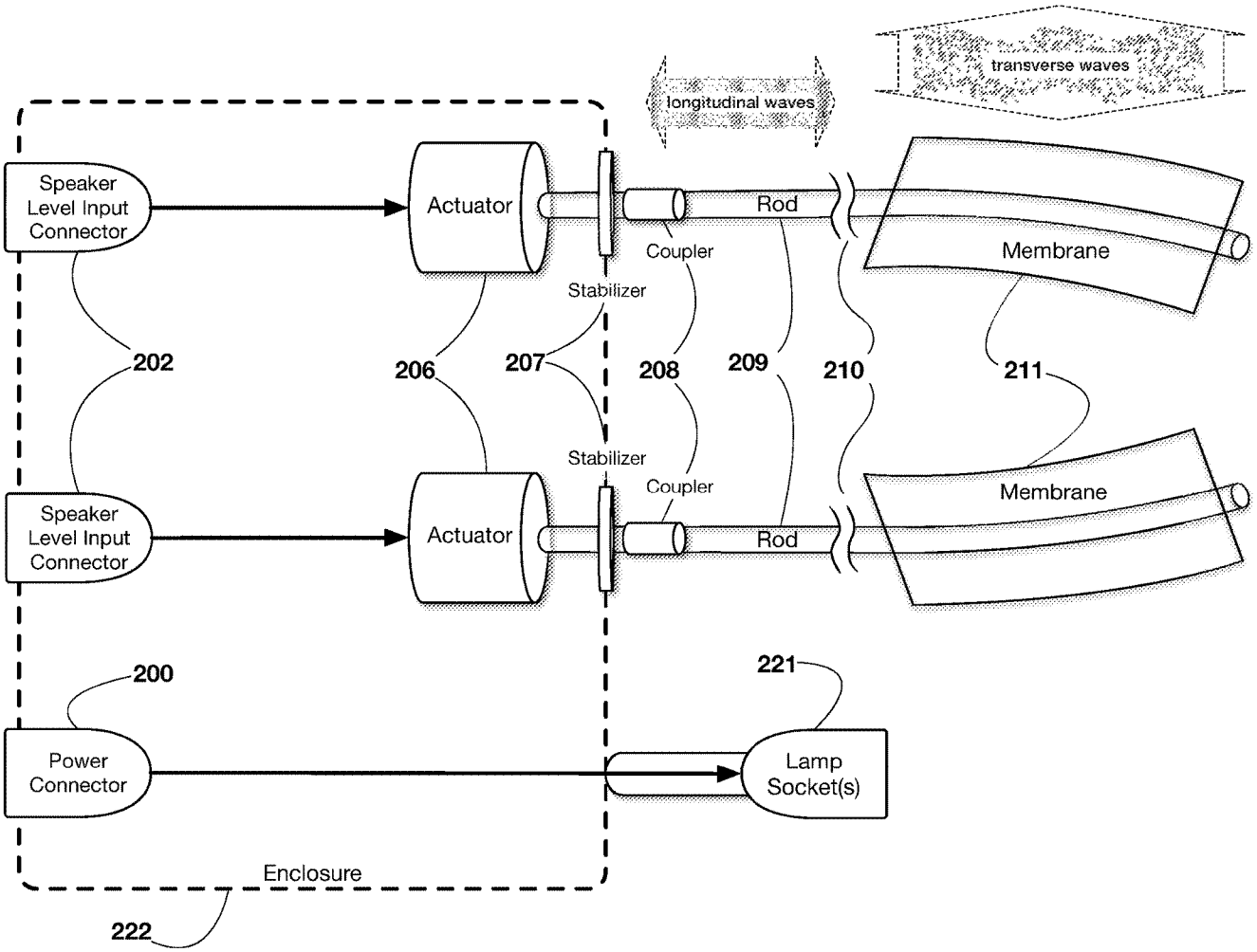
FIG. 1 is a schematic block diagram of a passive stereo system using dual hybrid diaphragms, according to aspects of the present teachings.

FIG. 1 is a system block diagram of a simple embodiment of an audio transducer, according to aspects of the present teachings. In this version the audio transducer is configured as a passive device requiring an external audio signal source and amplifier, such as a home theater receiver or a component stereo system. A power connector 200 is provided to supply electricity to one or more light sources such as lamp sockets 221 or the like.

Speaker level signals from an external audio amplifier are connected to the system input connectors 202. These signals directly drive the actuators 206, which are typically voice-coil drivers but may be other forms of electromotive actuators such as magnetostrictive or piezoelectric devices.

A two-channel stereo configuration is illustrated here. However, other configurations are possible within the scope of the present teachings, including mono, three-channel LCR, or larger numbers of channels. Furthermore, one or more actuators per audio channel may be connected, in series, parallel, or series-parallel combinations as desired depending on panel size and quantity, number of rods, and desired power-handling capability. The number of rods, their size and shape of the membranes can vary to optimize certain frequencies. In one preferred configuration (not illustrated), two actuators of nominal 8-ohm impedance are used for each audio channel. The two actuators are wired in parallel to present a 4-ohm load to the amplifier, and are physically coupled one to each end of a single rod spanning the membrane.

The actuators are typically contained in an enclosure 222, such as a tabletop base, that also serves to support the lamp socket(s) and vibrating elements of the system described below. Various configurations of enclosure are possible within the scope of this invention, including but not limited to single actuator table-top bases, multiple actuator housings for a single unit providing multiple channels of sound, as well as enclosures suitable for wall mounting, ceiling mounting, and suspension from a cable.

Regardless of the specific enclosure, the mechanical vibration output of each actuator is physically coupled to a rod 209. This rod is aligned in parallel with the primary axis of vibration of the actuator. A clearance hole is provided in the enclosure to permit free vibration of the rod. An axial stabilizer 207 is provided, secured to the enclosure, to reduce radial loads and excessive axial stress on the actuator. This stabilizer may take one of several forms, such a spiral leaf spring, a resilient grommet, or a magnetic suspension.

A rod coupler 208 is optional yet desirable for several reasons. The coupling allows for more compact packaging and shipping of products incorporating the invention. It can also facilitate easy replacement of panels by the user to economically support decorative/aesthetic options, and it also allows for inexpensive repair in the event of panel damage.

In some embodiments, the rod length 210 may be extended, as long as it remains straight, for a considerable distance (up to one or more meters if the rod is sufficiently stiff and straight, e.g. 5 mm diameter carbon fiber).

One or more membranes 211 are attached to the rod(s), in a configuration such that the longitudinal vibration of the rod is transferred to the membrane parallel to its surface. In one preferred embodiment (Sound Sail) the rods and membrane are curved at this point, and the final end of the rod is secured by a support (220 in FIG. 7). See below for further discussion of the rod and membrane construction and performance, and how transverse waves develop in the membrane and produce sound waves in the air.

Figure 2:
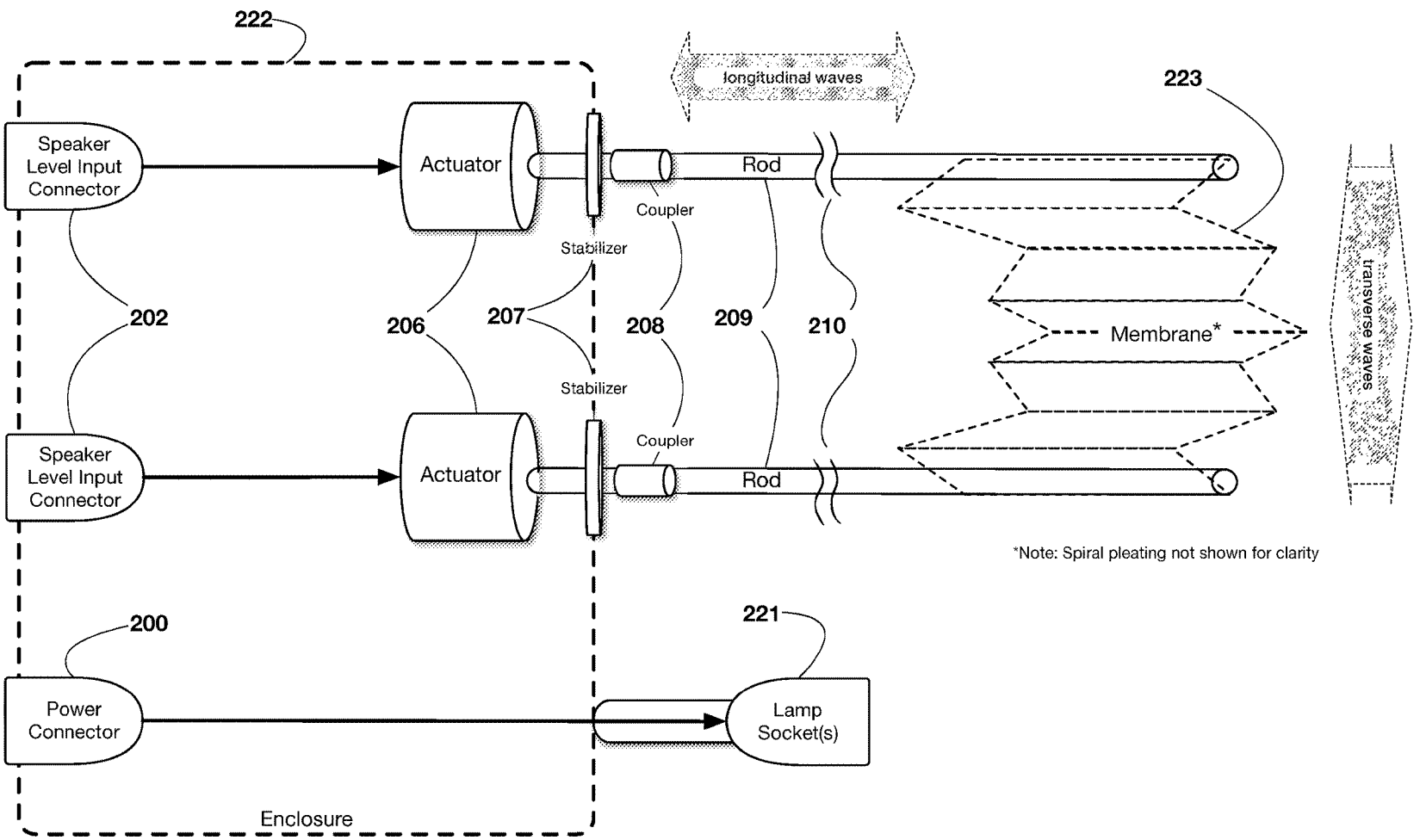
FIG. 2 is a schematic block diagram of a passive stereo system implementation using a single hybrid diaphragm, according to aspects of the present teachings.

FIG. 2 depicts a system configuration similar to the configuration of FIG. 1, except that a single membrane 223 is used, spanning both rods. Membrane 223 is also shown as a pleated membrane, which is an optional feature according to the present teachings. In some cases, membranes may be curved, or curved and pleated, such as configured in a pleated spiral shape.

Figure 3:
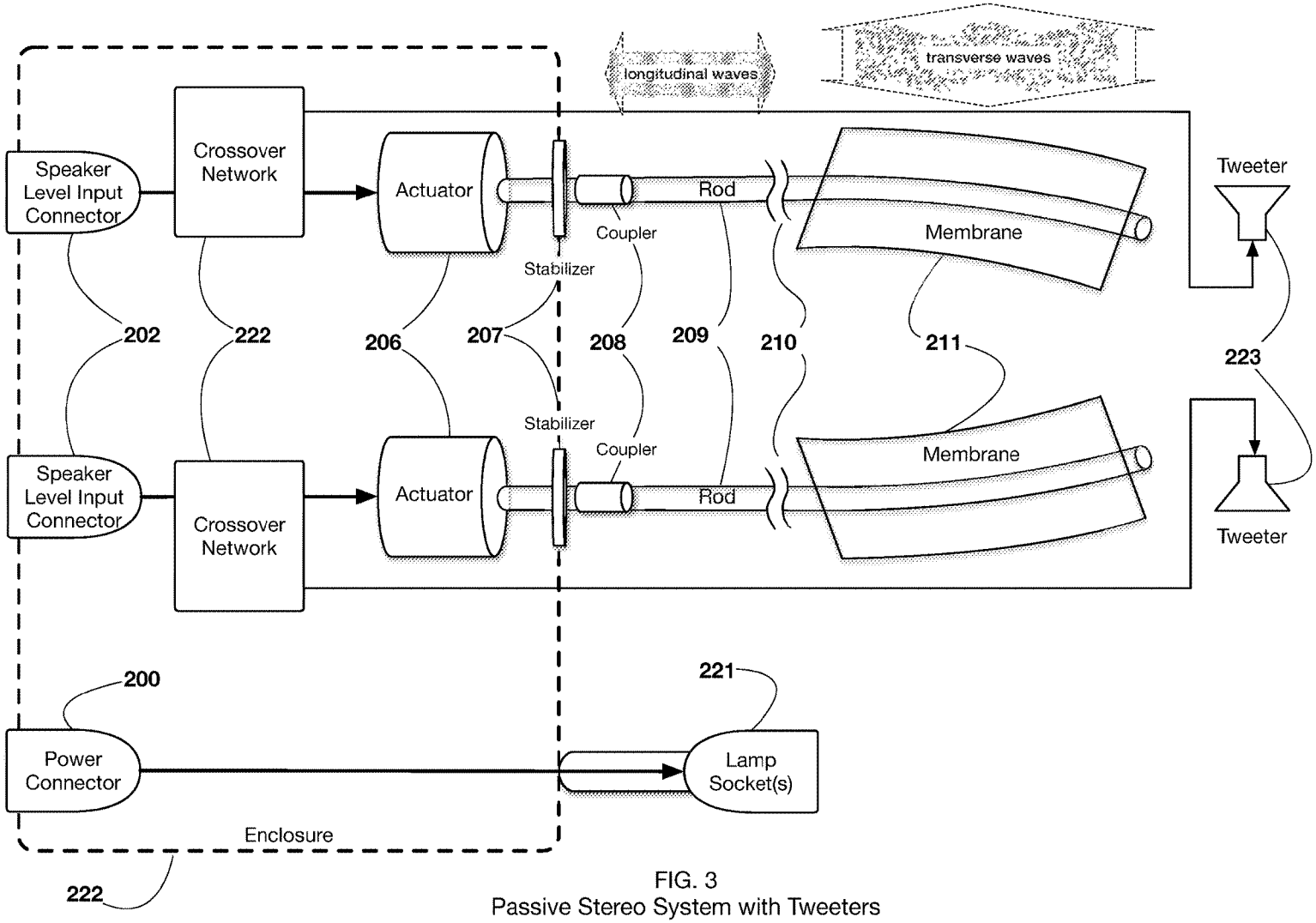
FIG. 3 is a schematic block diagram of a passive stereo system implementation using dual hybrid diaphragms, with the addition of a passive crossover network and tweeters, according to aspects of the present teachings.

FIG. 3 depicts a system configuration similar to the configuration of FIG. 1, with the addition of a passive crossover network 222. The crossover network may serve to attenuate low frequencies that may be beyond the reliable reproduction capabilities of a given actuator and panel configuration. The crossover may also optionally provide a high-frequency output to drive a separate tweeter transducer 223, to improve the overall frequency response of the system. The midrange bandwidth from the crossover is connected to the panel actuators 206.

Figure 4:
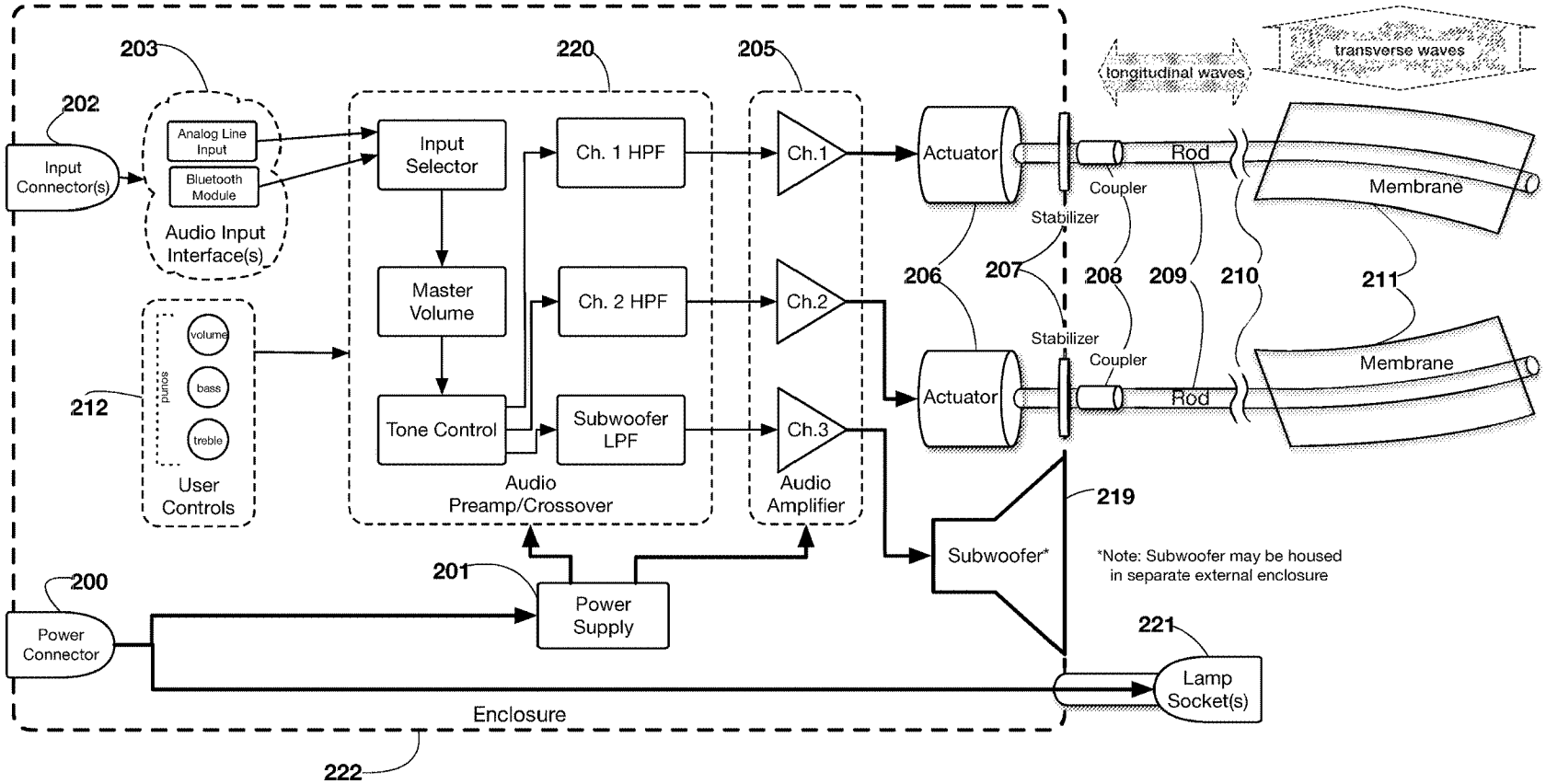
FIG. 4 is a schematic block diagram of an active 2.1 (stereo plus subwoofer) system implementation using dual hybrid diaphragms and analog tone controls and amplifiers, according to aspects of the present teachings.

FIG. 4 depicts an active analog system configuration. One or more input connectors 202 are provided, such as 3.5 mm TRS aux jacks as commonly used on mobile devices, phono jacks, or other typical analog audio connectors. One or more audio input interfaces 203 may also be fitted, including a module to provide wireless audio connectivity via Bluetooth or other suitable protocol. The line-level audio signals in this embodiment then pass through a circuit board 220 that provides several functions including input source selection, master volume control, tone control (e.g. treble and bass). These functions are adjustable by the user using knobs, sliders, or touch controls 212. The circuit 220 also provides active filtering of frequency bands to optimally drive internal audio power amplifiers 205. In the 2.1 configuration shown, two channels of amplification are used to drive the hybrid panel actuators 206, and a third channel is used to drive a subwoofer 219. The subwoofer may be housed within the main enclosure 222 or it may be provided in a separate enclosure so that it can be placed in another location if desired.

Figure 5:
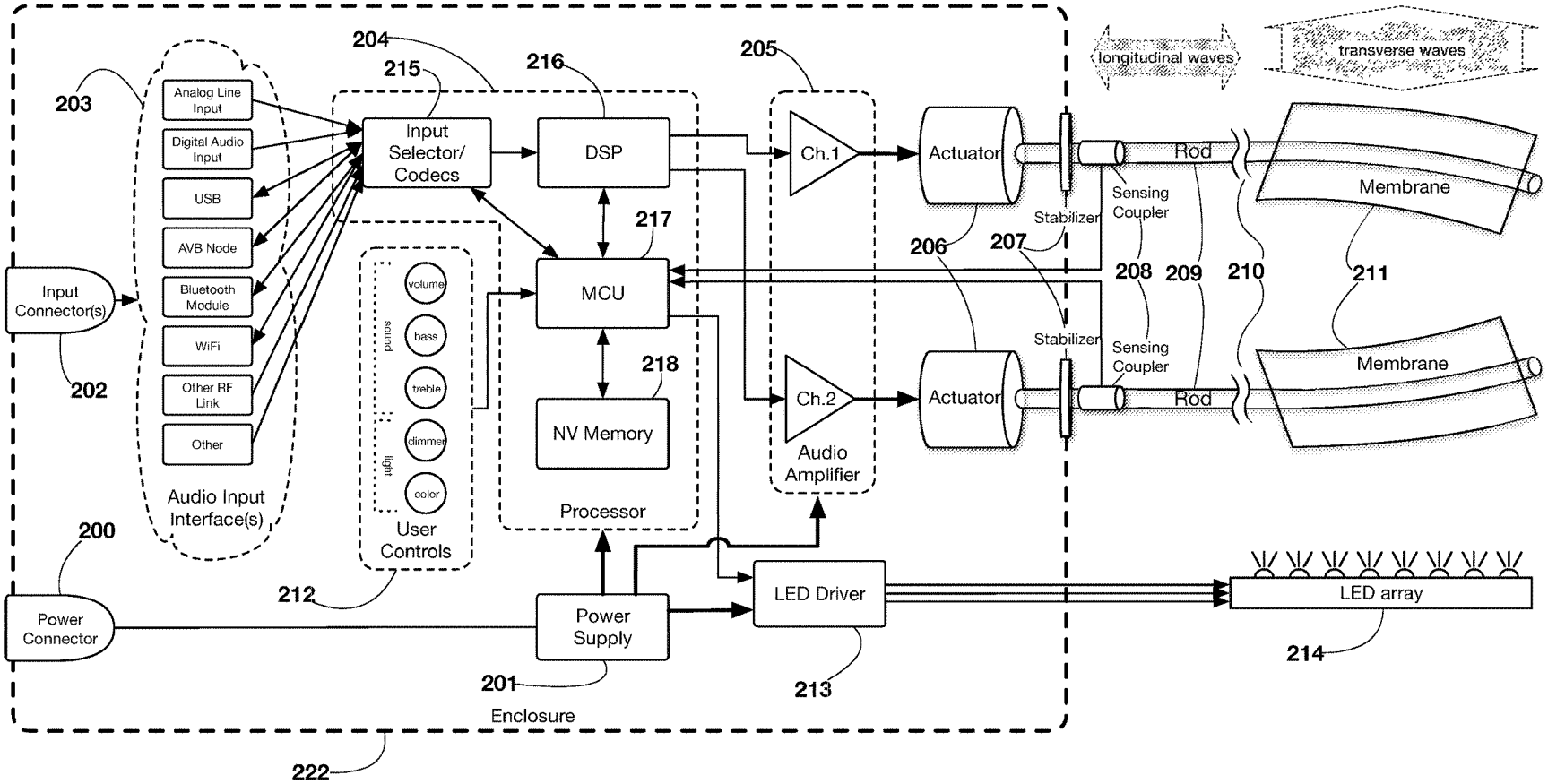
FIG. 5 is a schematic block diagram of an active stereo system using dual hybrid diaphragms with additional features including a digital controller and signal processor, multiple audio source options, and digitally controlled LED lighting, according to aspects of the present teachings.

FIG. 5 depicts an active stereo system configuration with further enhancements and features enabled by a digital processing circuit 204. The digital processor allows for the possibility of a greater plurality of audio input sources 203, including optional digital audio (SPDIF, Toslink, AES/EBU), USB audio interfaces compatible with smart phones and computers, AVB protocol over Ethernet for networked audio installations, Wi-Fi audio protocols, and so forth. Codecs and other interfaces 215 are supplied for each input source type used in a given embodiment of the invention. The selected source in digital form is then routed through a digital signal processor 216. The input interfaces and the DSP are controlled by, and may in some instances be integrated into, a micro controller unit (MCU) 217. User controls 212 in this embodiment may be simple knobs and switches or they may include additional controls and user feedback such as status displays, touch sensors, or any other typical digital UI. If independent speakers are utilized together, a setting on each speaker or an App program could direct certain musical channels, stems or frequencies to certain selected speakers. For example, in a 2 speaker configuration for stereo sound, a left channel speaker could receive only the left channel sound or by flipping a switch on the speaker only play the left channel of the stereo sound while the other speaker will play only the right channel. This concept can be expanded to other digital processing systems such as 5.1 or 7.1.

Non-volatile memory (e.g. an SD card or similar) is also optionally provided. In addition to storing user preferences the memory store may also be used to store sound samples, in order to implement an audio user interface (AUI), where the system provides its own sound effects and audible feedback in response under software control.

The DSP 216 also provides the tone control and crossover functions as needed to provide signals for a given configuration of hybrid panel actuators, and additional drivers (subwoofers and or tweeters) as needed. These signals are routed from the DSP to the amplifier 205, which may be a digital amplifier (class D) or an analog amplifier. The amplifier output drives the actuators and any other drivers such s a subwoofer, similar to previous configurations described above.

The rod couplers 208 in this full-featured version may furthermore be fitted with sensors that are able to distinguish between the different varieties of replaceable diaphragms that may be offered. This mechanism may be implemented using Hall-effect magnetic sensors, optical sensors, conductance sensors, or other means. This feature makes it possible for the MCU to automatically load DSP settings that have been optimized for a given diaphragm. This feature could also be used for other functions, including for example special panels that are encoded with a key that automatically triggers playback of specific audio content stored in memory 218. Or, in the case of a Bluetooth or other network connection to an external digital audio player, a specific panel could communicate with a software application running on the external device such as a smart phone, to provide additional custom features.

The MCU 217 also provides control signals (typically pulse-width modulated square waves at supersonic frequencies to avoid audio interference) to an LED driver 213. The LED driver supplies variable power to LEDs mounted adjacent to the diaphragms and/or elsewhere on the enclosure. This configuration of control electronics may be programmed to provide a simple brightness dimming function, or more complex features may be implemented such as audio-responsive lighting and coordination with other paired speakers.

Figure 6:
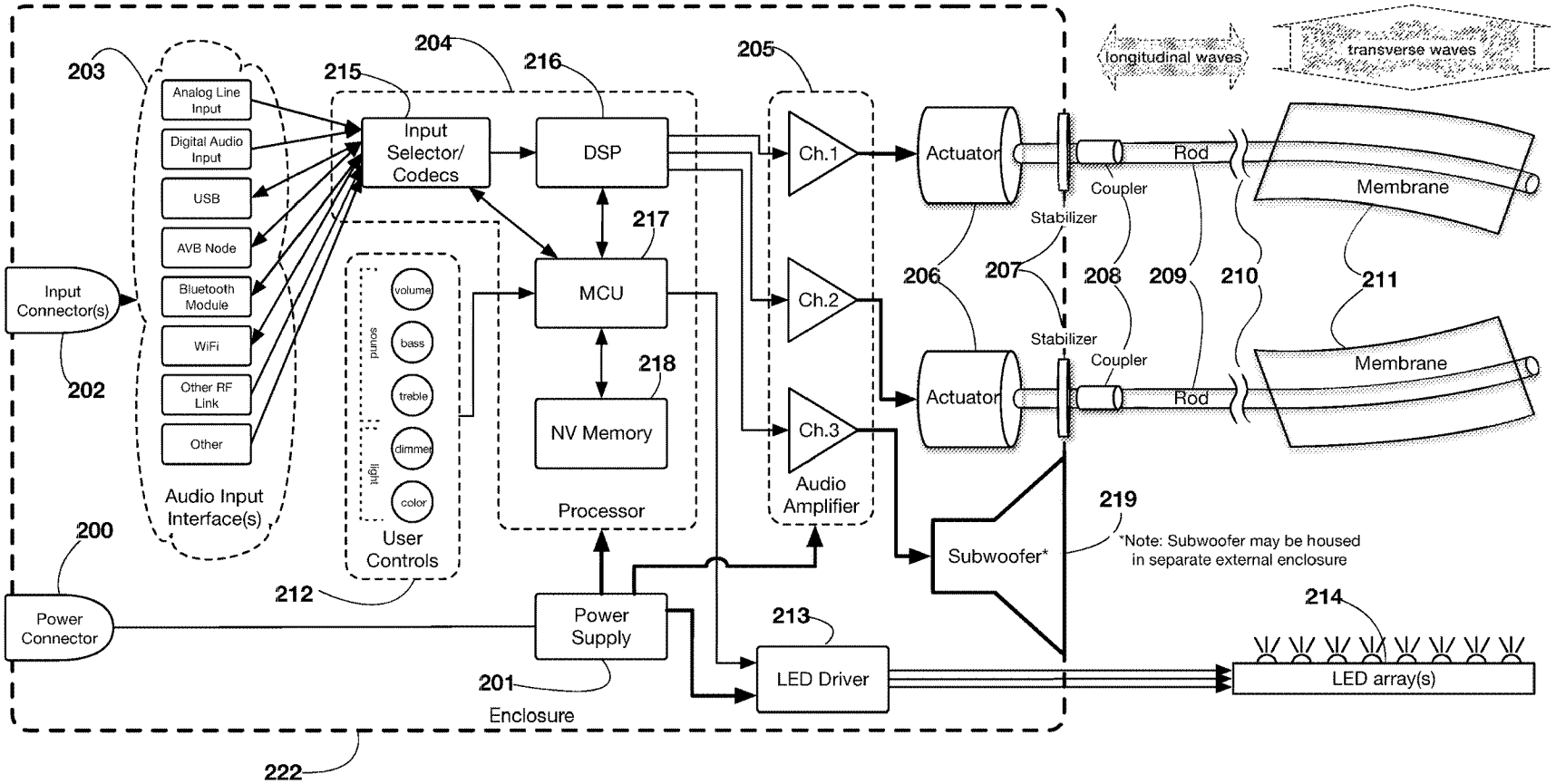
FIG. 6 is a schematic block diagram of an active 2.1 (stereo plus subwoofer) system using dual hybrid diaphragms with additional features including a digital controller and signal processor, multiple audio source options, and digitally controlled LED lighting, according to aspects of the present teachings.

FIG. 6 depicts a preferred full-featured embodiment that combines the digital processing of the embodiment of FIG. 5 with the 2.1 subwoofer features of the embodiment of FIG. 4. Additional permutations and combinations of features are possible within the scope of this invention.

Figure 7:
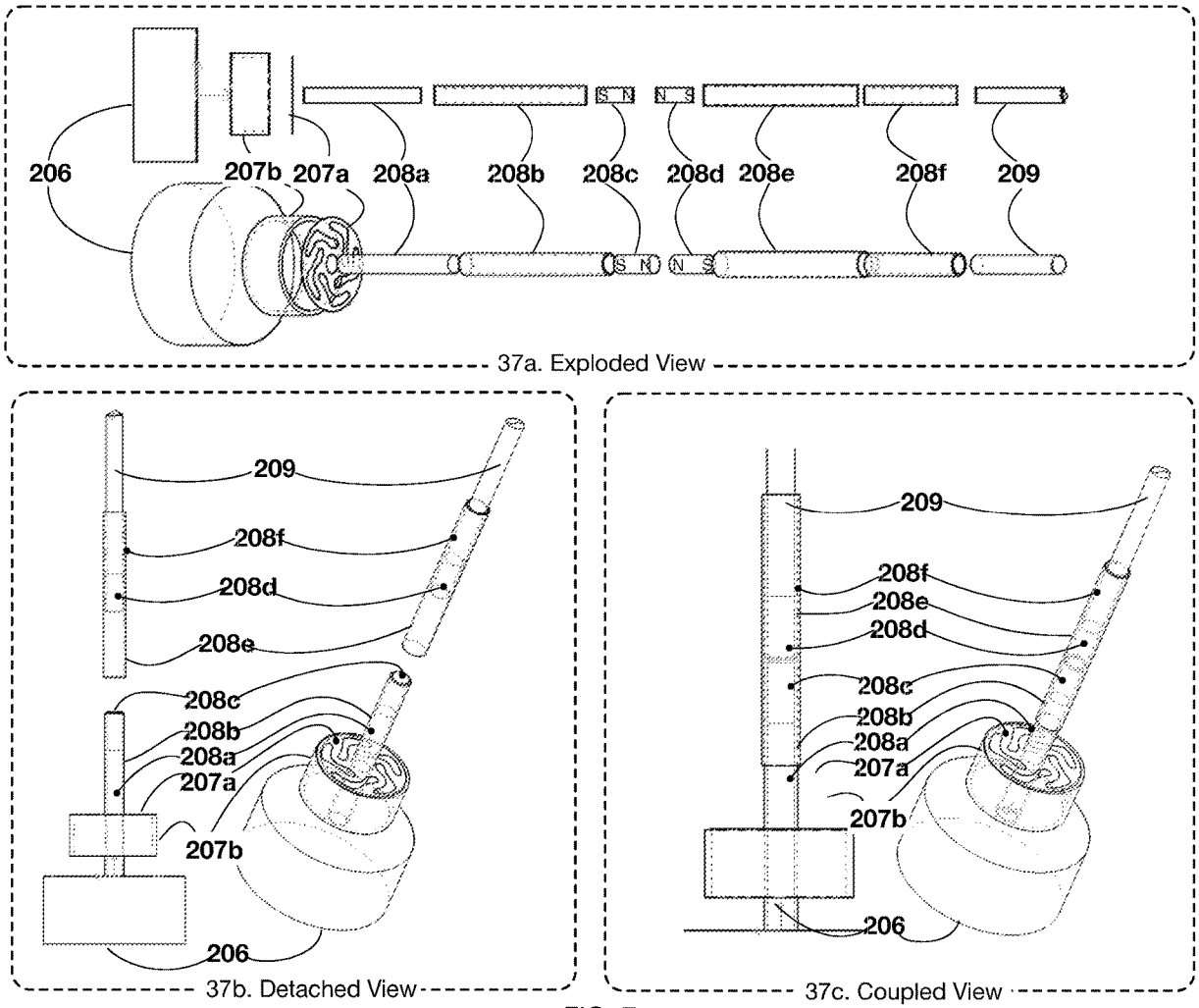
FIG. 7, which incorporates

FIG. 7 depicts details of a coupling between an elongate rod and an actuator, as well as depicting an axial stabilizer for the actuator, according to aspects of the present teachings.

In one preferred embodiment, the coupling is comprised of a combination of telescoping tubes and magnets as detailed in FIG. 7. Other known coupling techniques can be utilized. Assuming an exemplary rod diameter of 5 mm, a length of 5 mm ID tubing 208*b* is placed over a short length of rod 208*a* that is attached to the actuator 206. The actuator rod and tube 208*a/b* pass through the center hole in the stabilizer 207*a*, and are of sufficient length to reach the actuator inside the enclosure. This length is typically 4-5 cm and may vary depending on the specific design of the stabilizer mount 207*b*.

Tubing 208*b* extends beyond the free end of the actuator rod 208*a*, leaving a hollow cavity. A cylindrical magnet 208*c*, for instance constructed from nickel-plated neodymium, is inserted into the hollow cavity and tightly secured by press-fit, a suitable adhesive such as epoxy, or other known securing means that will withstand sustained vibration without coming loose over time. Note that the magnet extends beyond the end of the tube; this helps insure a positive mating surface to the matching socket in the panel rod, and it facilitates cleaning of the magnet should any stray ferrous particles become attracted to it over time.

On the mating end of the panel rod, a similar piece of tubing 208*f* and a similar magnet 208*d* is attached in the same manner to the panel rod. The polarity of the magnet 208*d* is oriented to attract the magnet 208*c* in the actuator rod. Then an additional length of tubing 208*e*, with a slightly larger inner diameter that closely matches the outer diameter of the above-mentioned tubes 208*b/f* is fitted, to provide a telescoping sleeve. The telescoping sleeve provides radial stiffness to maintain alignment and structural integrity of the two rods when they are coupled together, and an axial guide to coupling the rods.

The magnets provide an axial connection superior to other methods such as threaded or snap-lock plastic couplings, in that the magnetic coupling transfers vibration reliably throughout the audio frequency range without danger of coming loose. Since all of the acoustic energy of the transducer passes through this coupling, it is a crucial feature that it does not cause rattle, buzz, or other degradation of the sound vibration. In another embodiment, more than one rod can be mechanically coupled to a single actuator.

Figure 8:
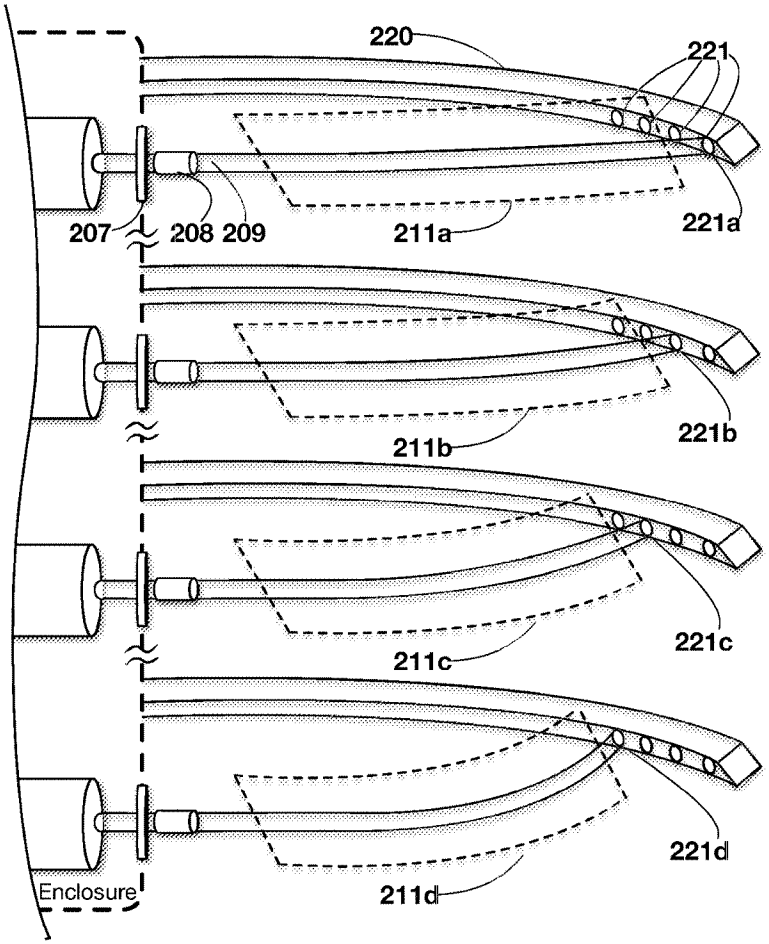
FIG. 8 depicts a series of side elevational views of a hybrid diaphragm illustrating how curvature of the diaphragm may be altered, according to aspects of the present teachings.
Figure 9:
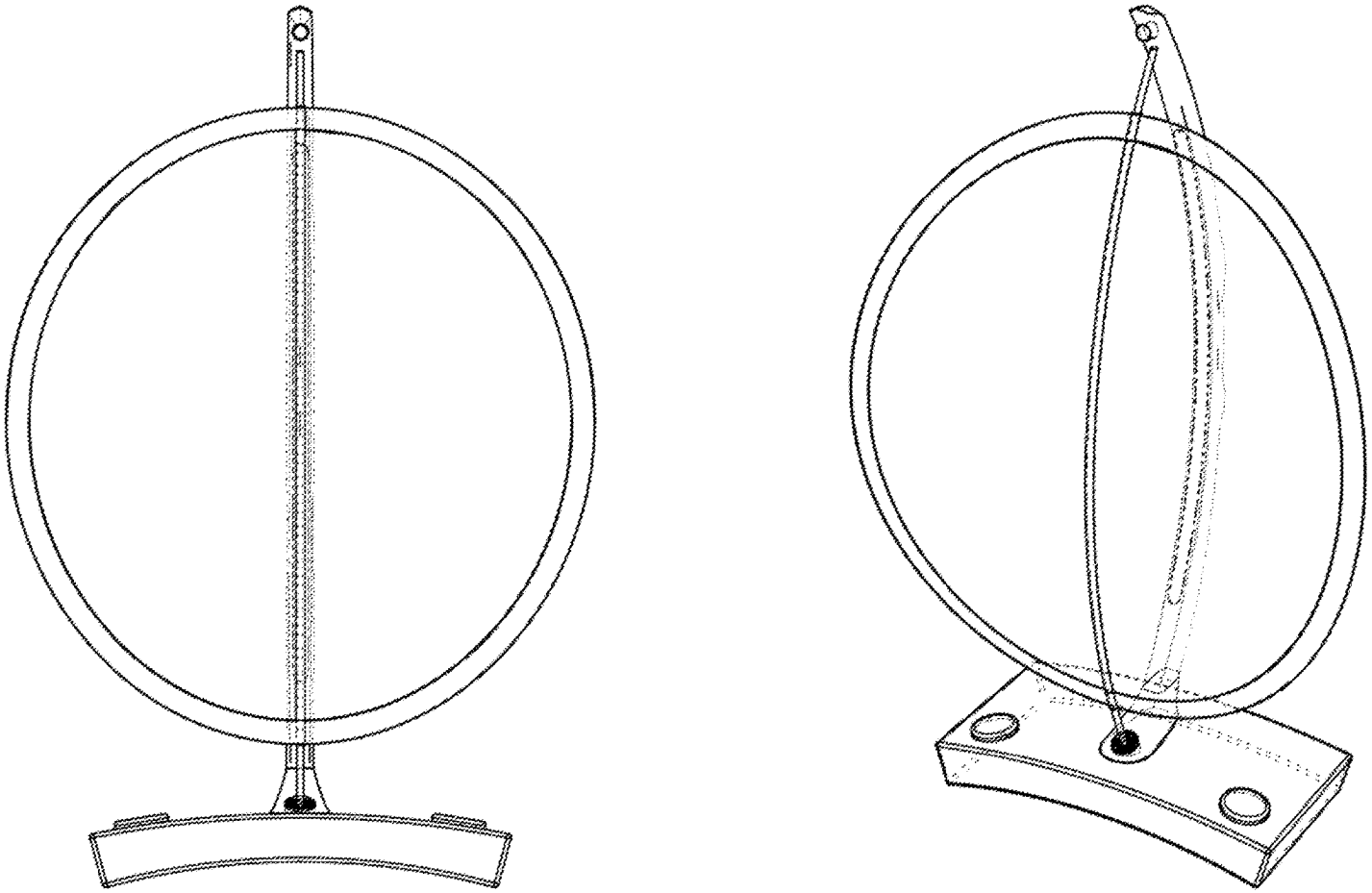
FIG. 9 includes a front elevational view and a three-quarter perspective view of an embodiment of a speaker including a hybrid diaphragm, according to aspects of the present teachings.
Figure 10:
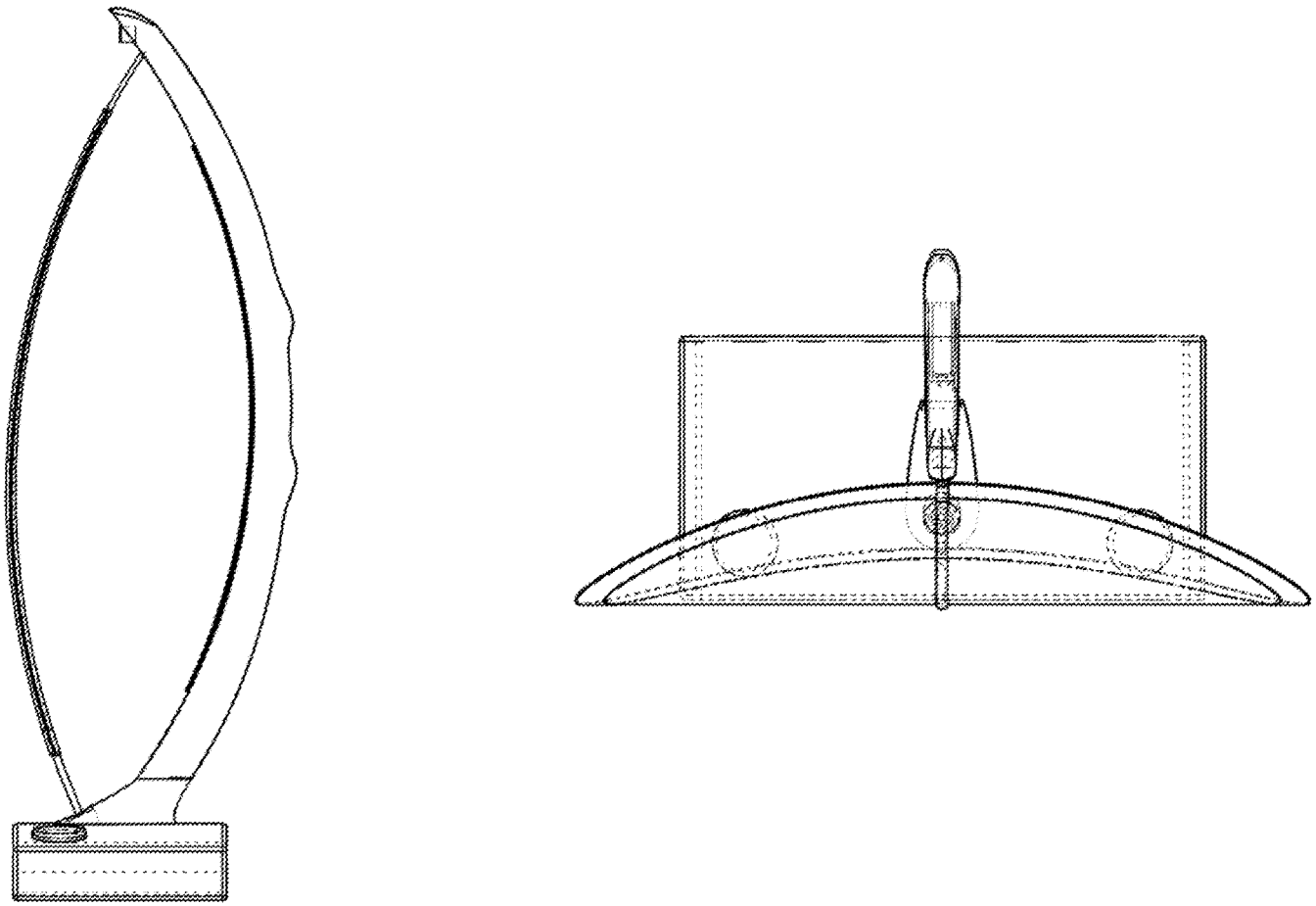
FIG. 10 includes a side elevational view and a top plan view of the speaker embodiment shown in FIG. 9.

FIG. 8 depicts in schematic form one method of mechanically adjusting the curvature of the hybrid diaphragm. A support member 220 attached to the enclosure acts to secure the free end of the rod. (This member may also house LEDs to light the panel.) For variable curvature, a series of receptacles 221 are provided. These receptacles may be simple holes in the support or preferably, they are constructed in a manner similar to the actuator magnetic coupling 208, in order to avoid unwanted vibration and noise at the rod/support connection point.

FIG. 8 shows one hybrid diaphragm in four different conditions, ranging from minimal curvature at the top (membrane position 211*a*, rod inserted in receptacle 221*a*) to a greater degree of curvature at the bottom (membrane position 211*d*, rod inserted in receptacle 221*d*).

The degree of diaphragm curvature has a complex effect on the sound quality, tone, EQ signature and furthermore different panel styles may perform optimally at different curvatures. Allowing for user adjustment of the panel curve may also increase the overall appeal of the invention by encouraging experimentation, and allowing further personalization of the musical tone.

II. Exemplary Embodiments

This section describes specific exemplary embodiments of audio transducers according to aspects of the present teachings; see FIGS. 9-23.

Figure 11:
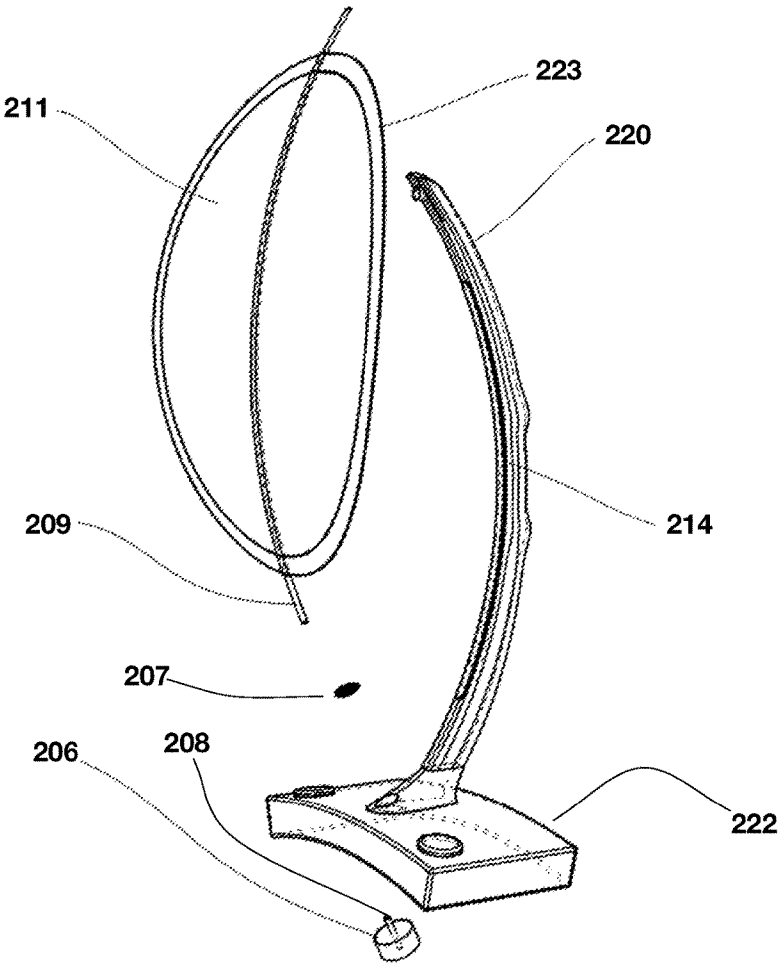
FIG. 11 is an exploded perspective view of the speaker embodiment shown in FIG. 9.
Figure 12:
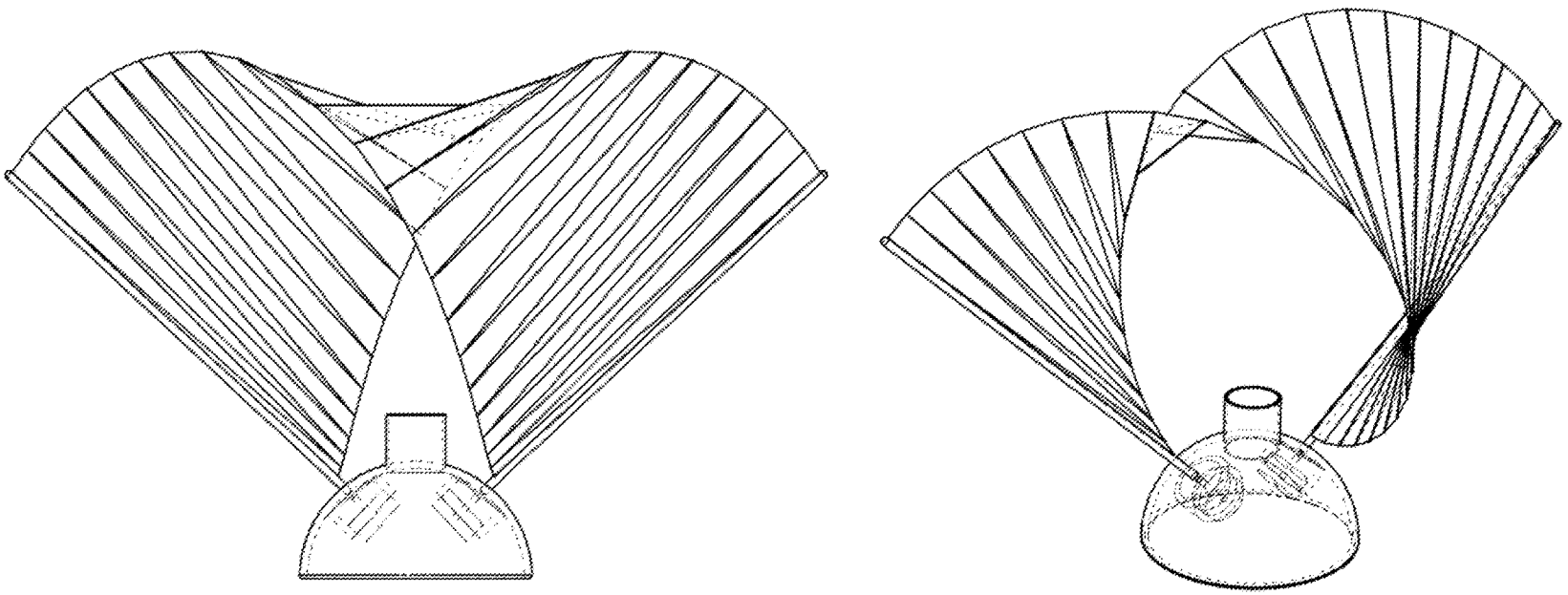
FIG. 12 includes a front elevational view and a three-quarter perspective view of another embodiment of a speaker including a hybrid diaphragm, according to aspects of the present teachings.
Figure 13:
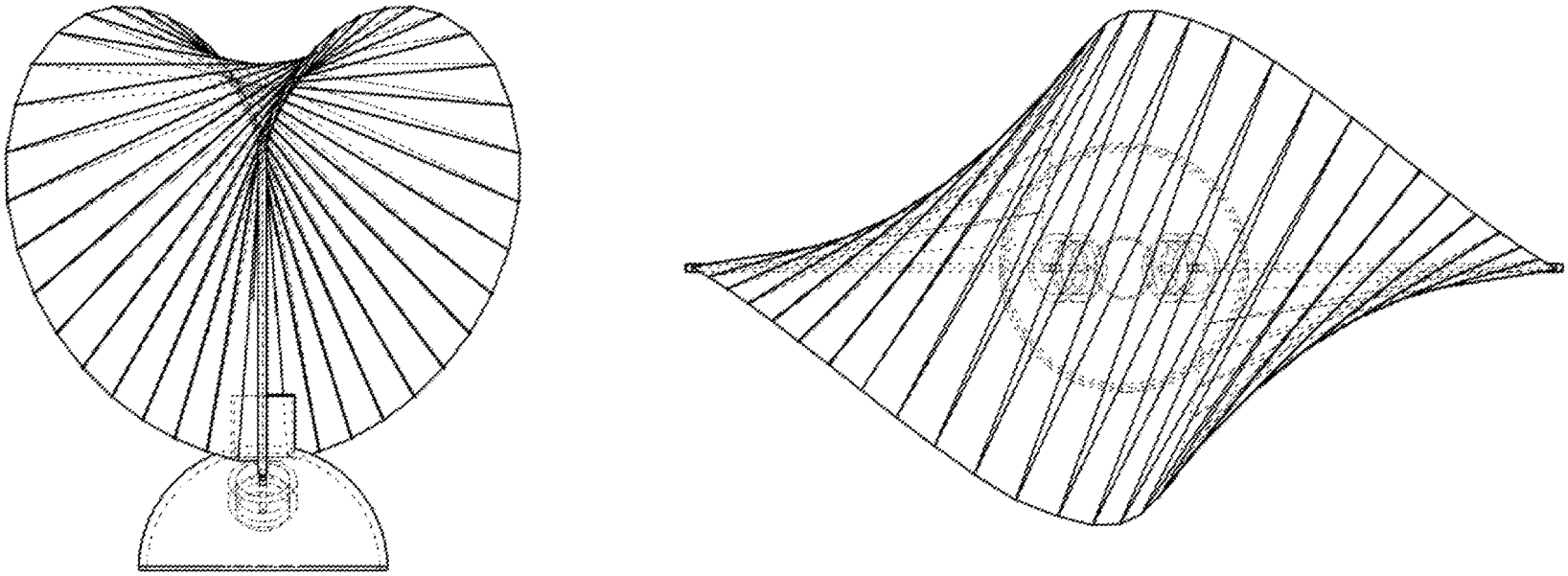
FIG. 13 includes a right side elevational view and a top plan view of the speaker embodiment depicted in FIG. 12.
Figure 14:
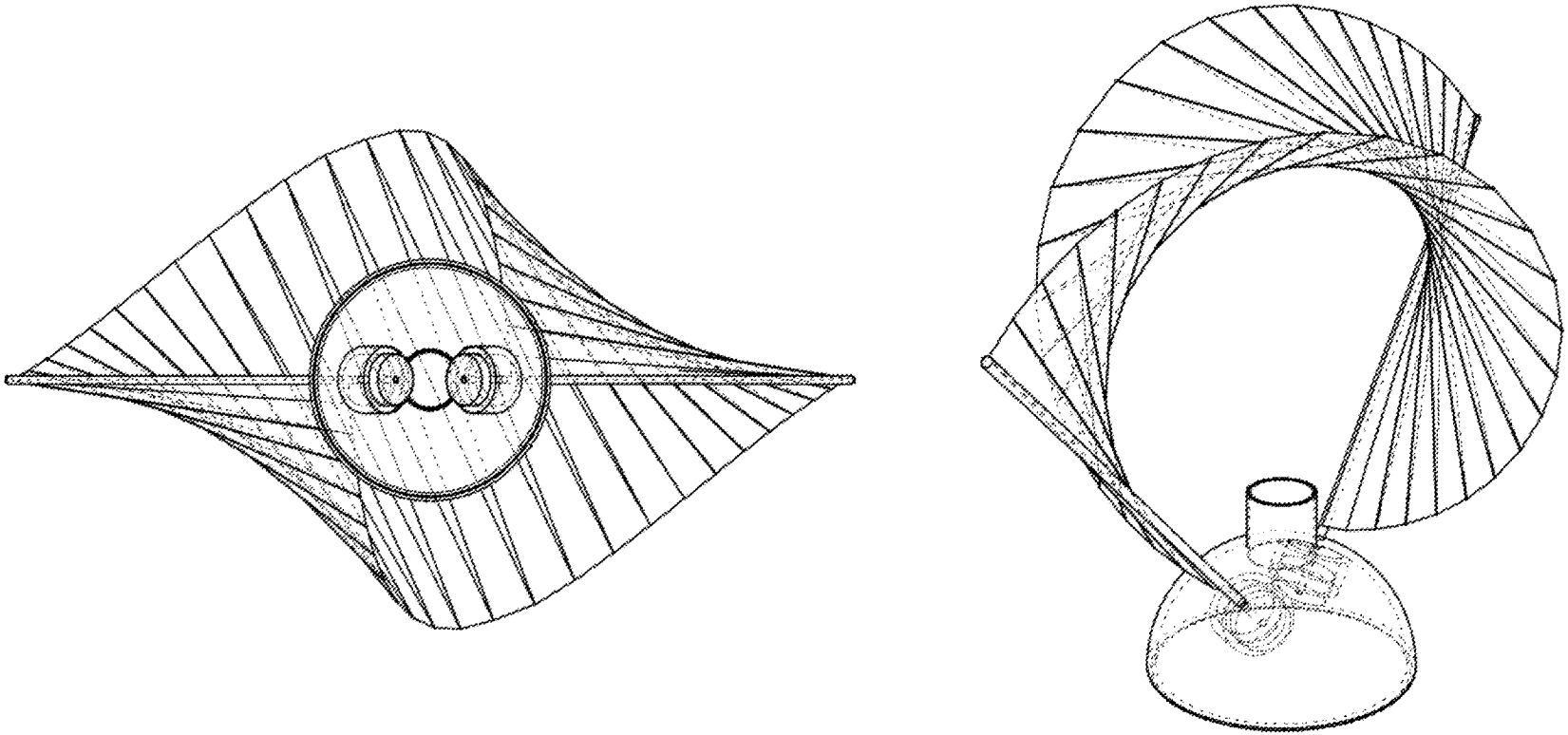
FIG. 14 includes a bottom plan view (showing the actuators inside the base) and also a side perspective view of the speaker embodiment depicted in FIG. 12.
Figure 15:
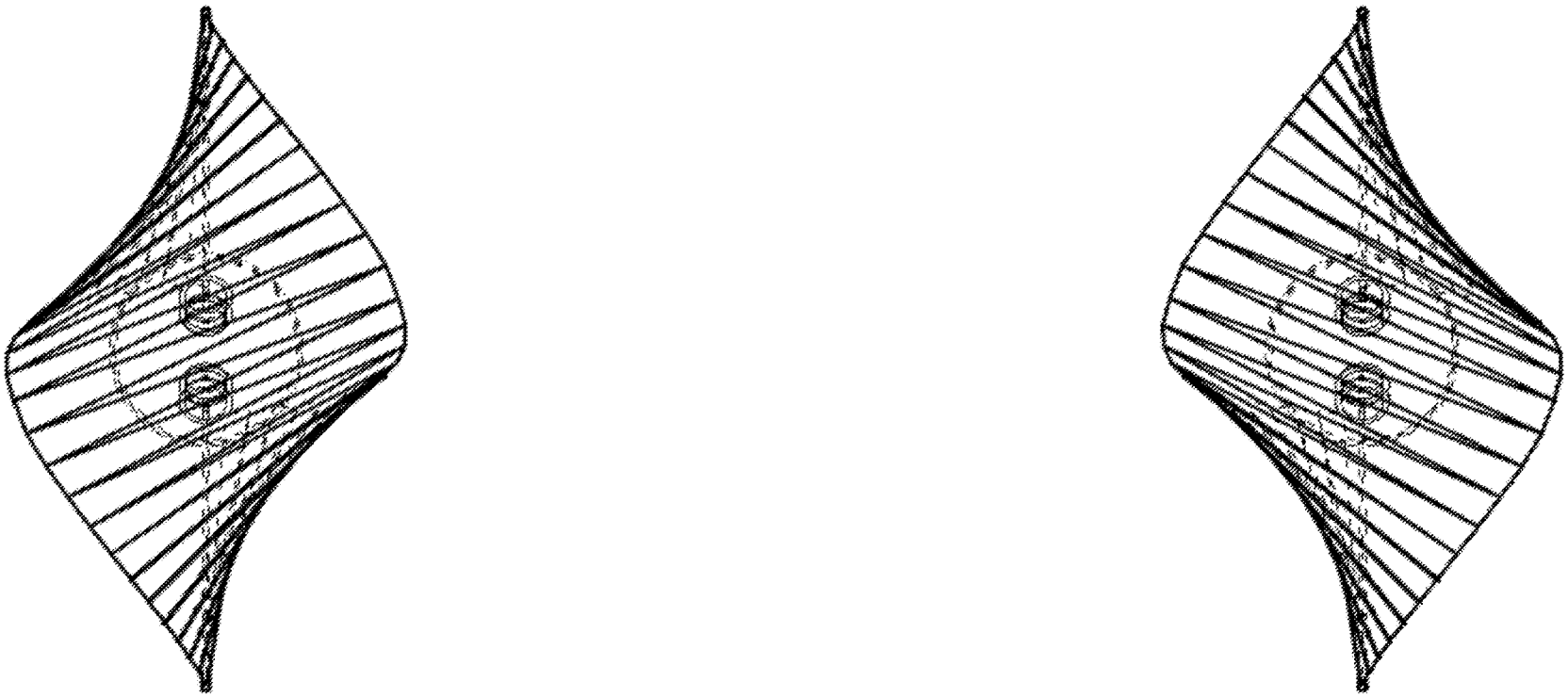
FIG. 15 is a front elevational view of a wall-mounted stereo pair of speakers, each of the type depicted in FIG. 12.
Figure 16:
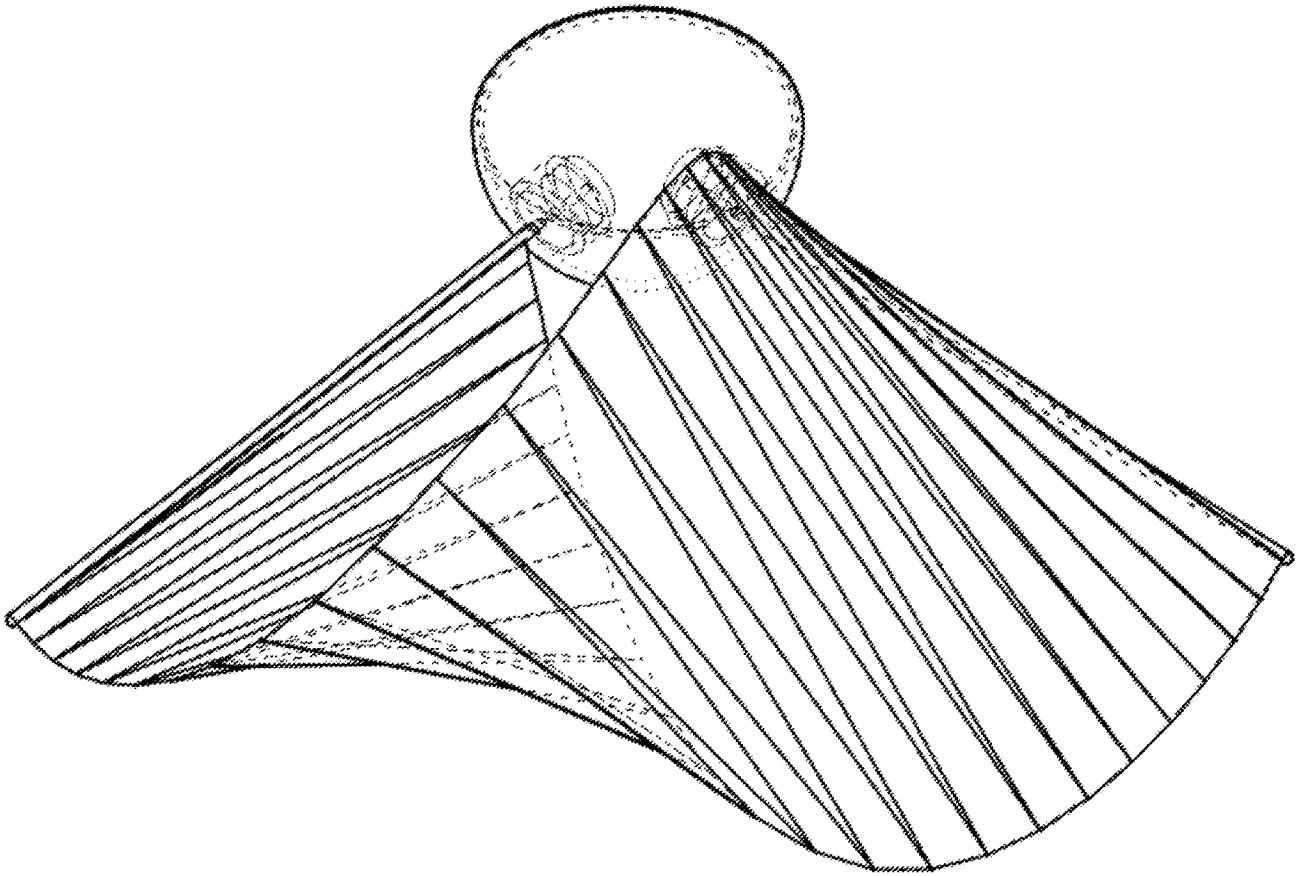
FIG. 16 is a perspective view looking up at invention speaker of the type depicted in FIG. 12, oriented as a ceiling-mounted fixture providing light and sound.
Figure 17:
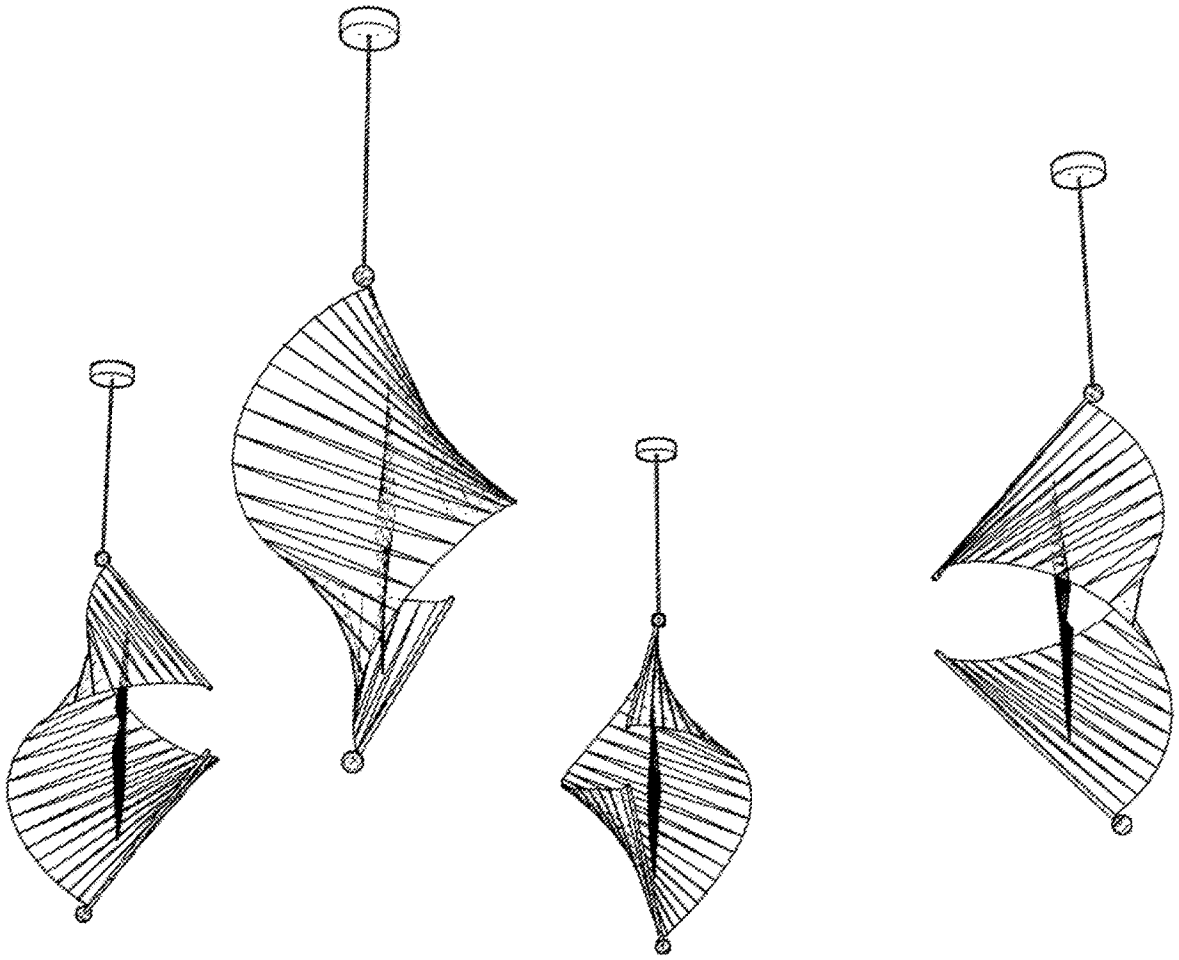
FIG. 17 is a perspective view looking up at an array of four large-scale (approx. 2 m tall) speakers, each of the type depicted in FIG. 12.
Figure 18:
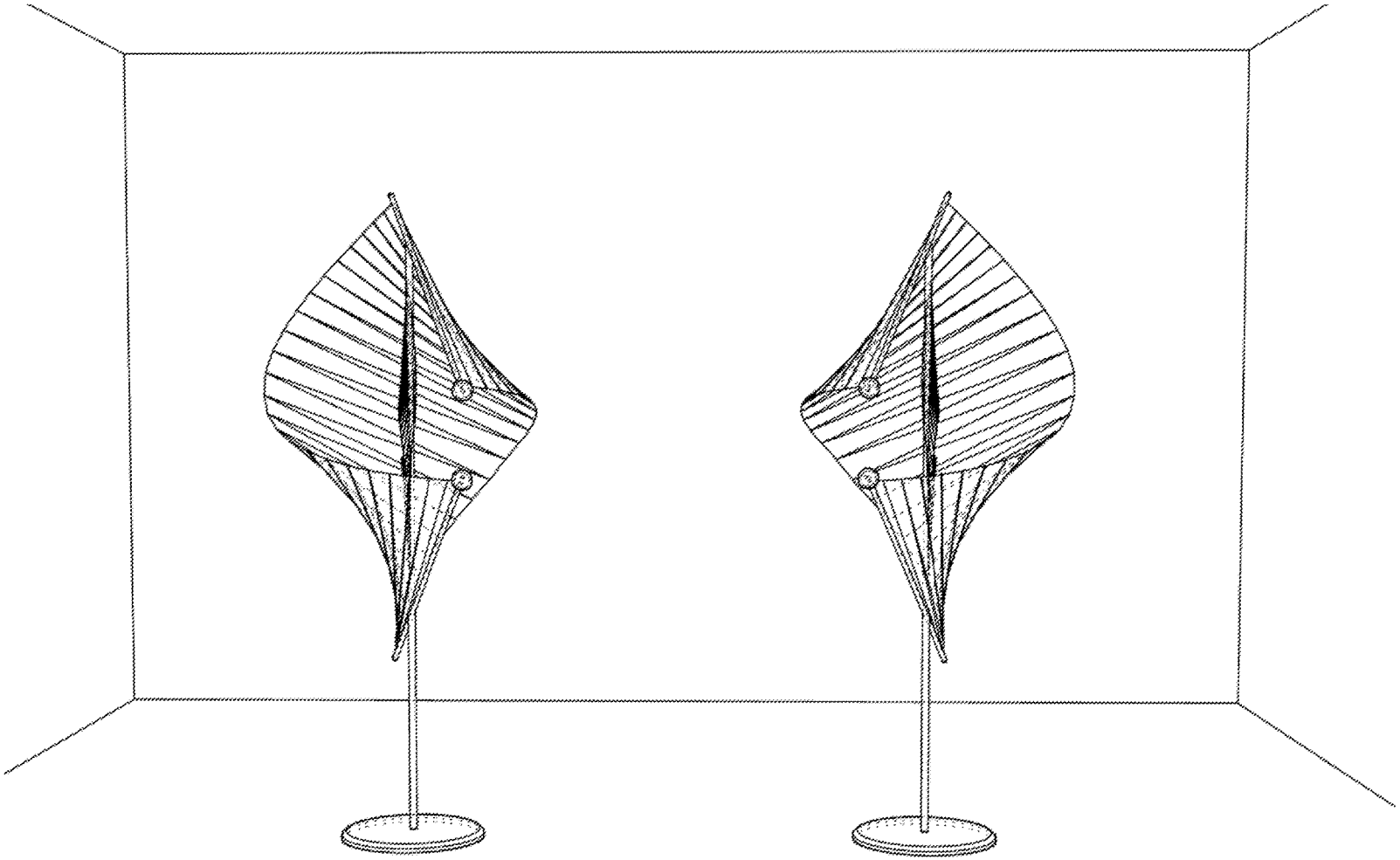
FIG. 18 is a front perspective view of a stereo pair of large-scale (approx. 2 m tall) speakers, each of the type depicted in FIG. 12.
Figure 19:
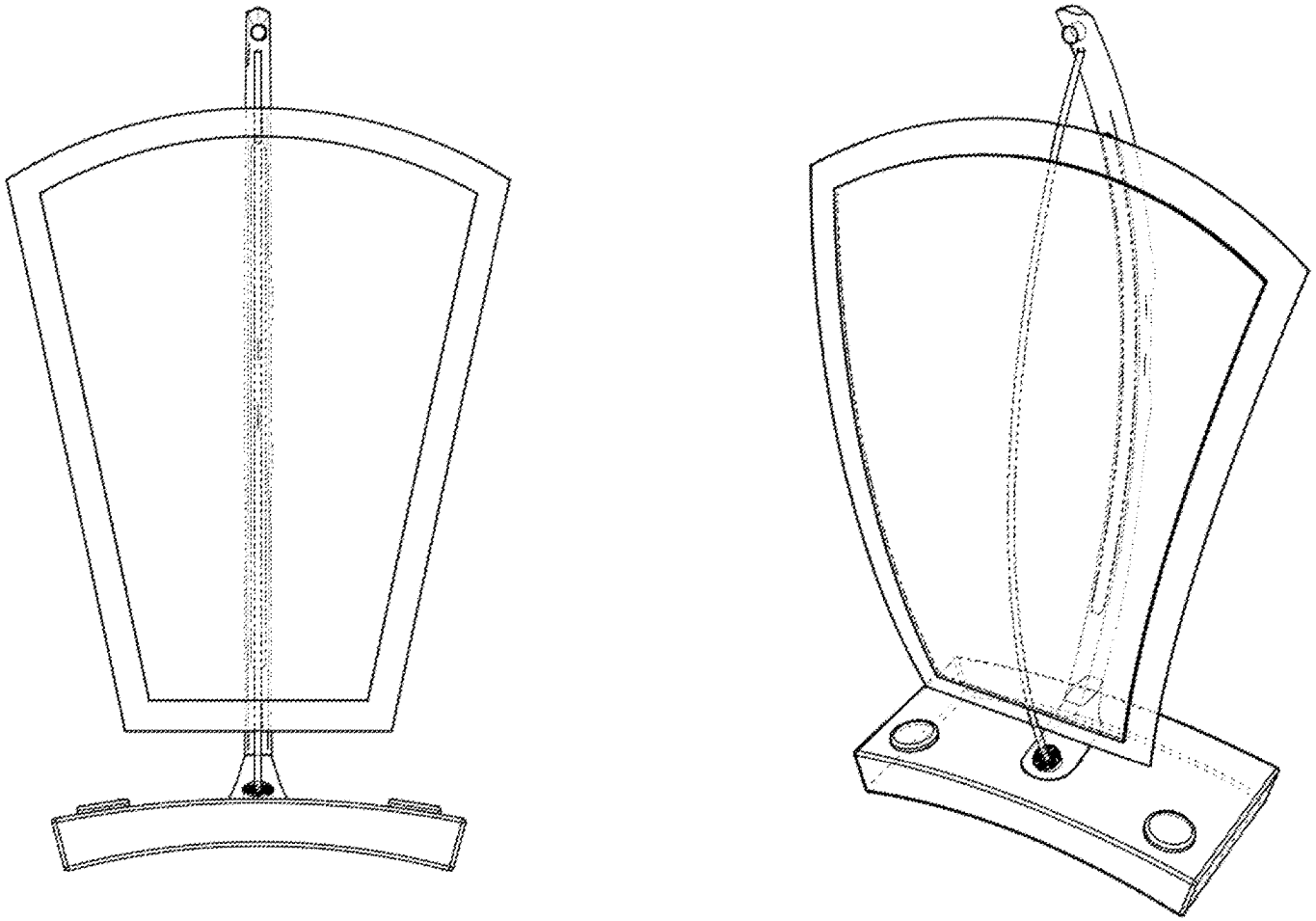
FIG. 19 includes a front elevational view and a three-quarter perspective view of an embodiment of a speaker including a hybrid diaphragm, a "an" style replaceable panel and an arched base, according to aspects of the present teachings.
Figure 20:
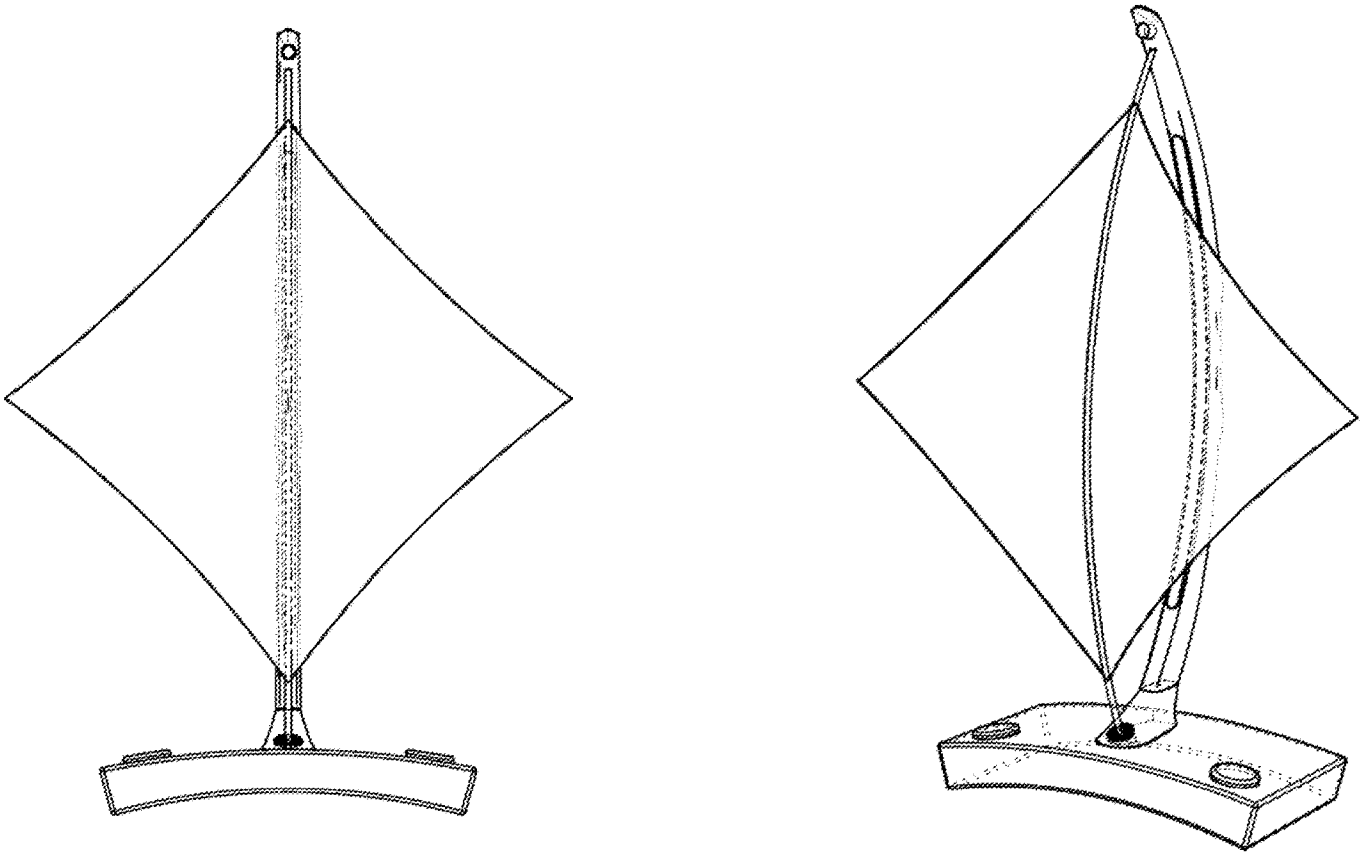
FIG. 20 includes a front elevational view and a three-quarter perspective view of an embodiment of a speaker including a hybrid diaphragm, a riations" style replaceable panel and an arched base, according to aspects of the present teachings.
Figure 21:
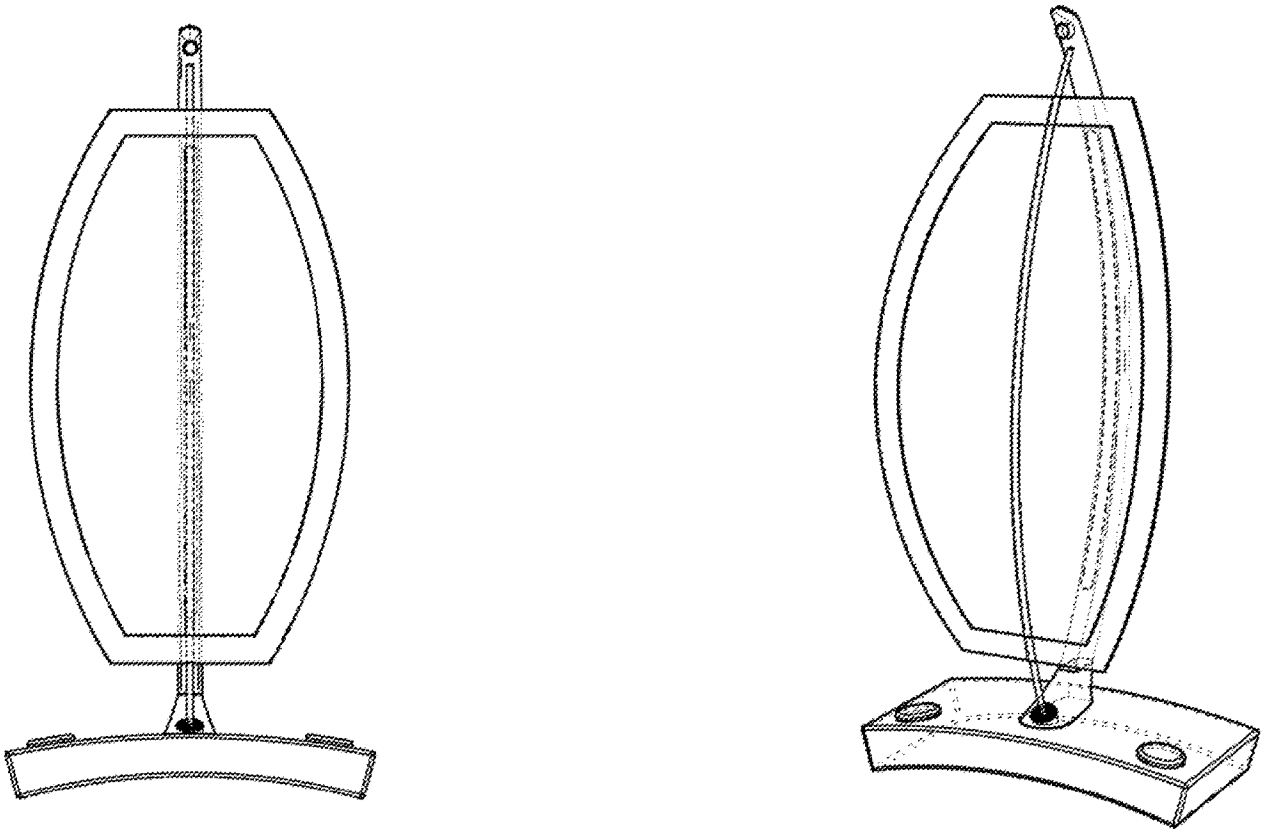
FIG. 21 includes a front elevational view and a three-quarter perspective view of an embodiment of a speaker including a hybrid diaphragm, a "shield" style replaceable panel and an arched base, according to aspects of the present teachings.
Figure 22:
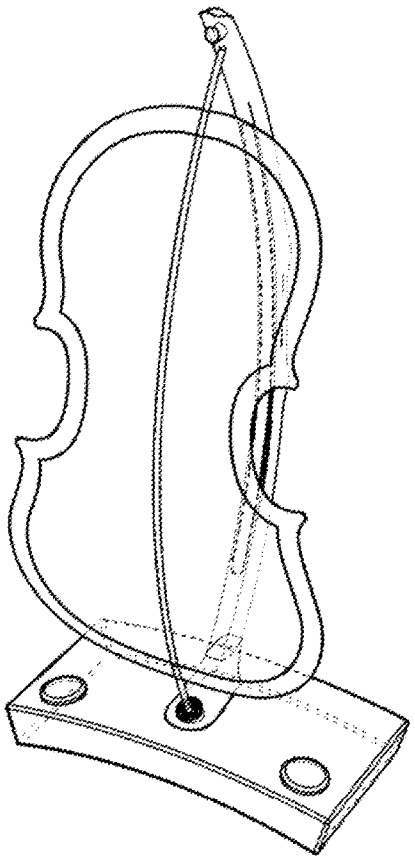
FIG. 22 includes a front elevational view and a three-quarter perspective view of an embodiment of a speaker including a hybrid diaphragm, with a replaceable panel shaped to resemble a classical string musical instrument such as a cello, according to aspects of the present teachings.
Figure 22:
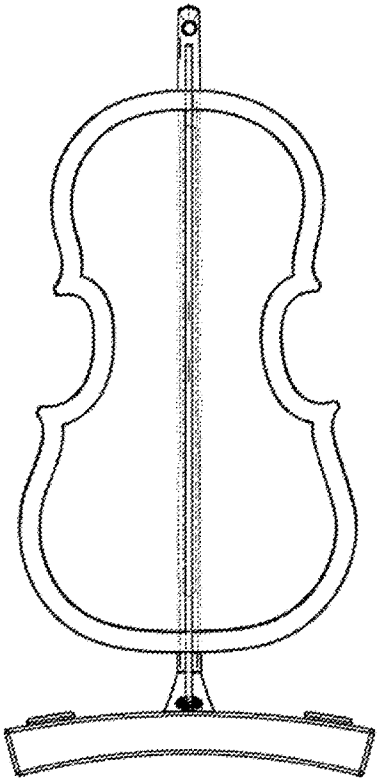
Figure 23:
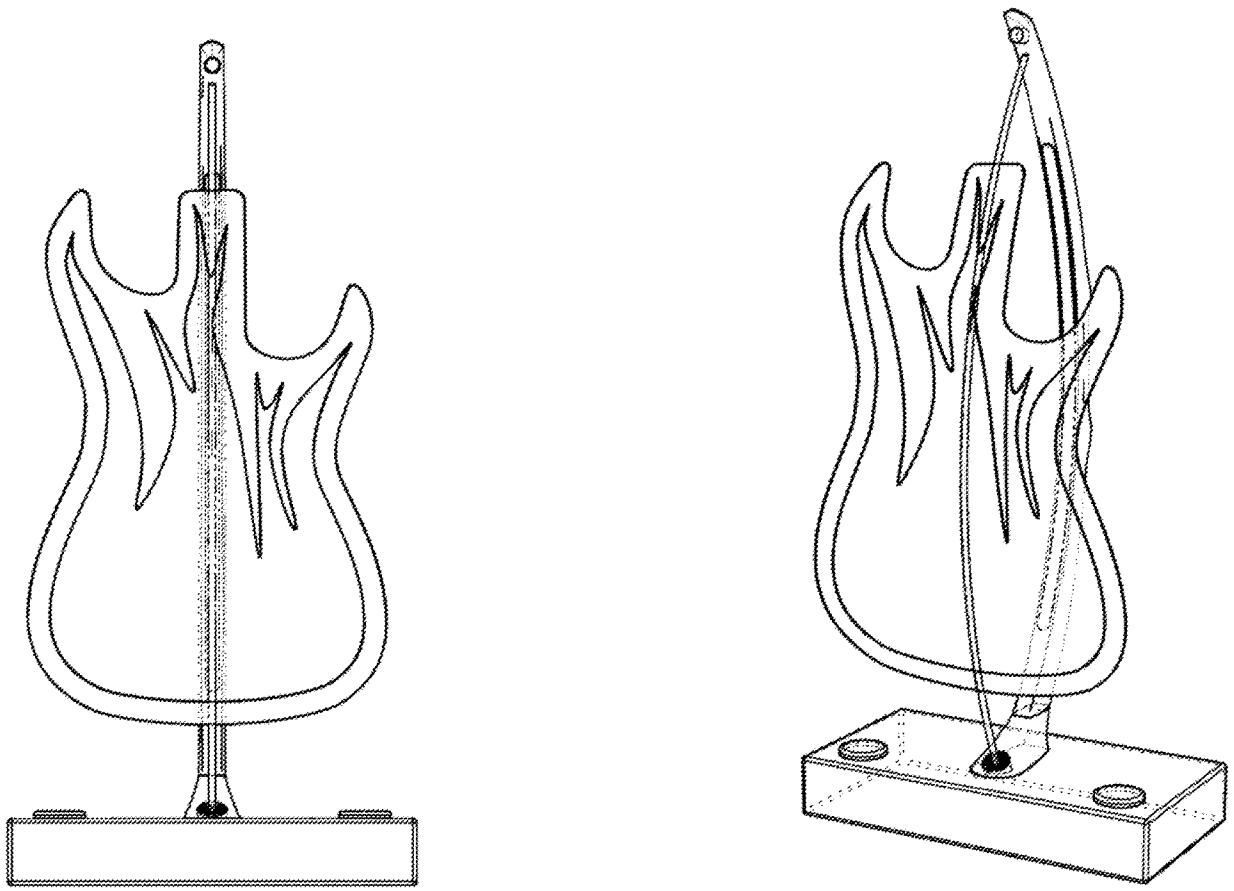
FIG. 23 includes a front elevational view and a three-quarter perspective view of an embodiment of a speaker including a hybrid diaphragm, with a replaceable panel shaped to resemble a decorated electric guitar body, according to aspects of the present teachings.

In the discussion below, the term "panel" refers to the complete diaphragm assembly, such as assembly 223 (see FIG. 11 for numbering). The term "membrane" refers to the curved surface, such as surface 211 that provides the primary surface where panel vibration is coupled to the air and hence provides sound. The term "rod" refers to the member, such as member 209 that provides optimized coupling between the vibration source and the membrane. The term "actuator" refers to the vibration source, such as source 206, and may be any form of linear electromotive transducer, although specialized voice-coil transducers are preferred.

EXAMPLE 1

"Sound Sail" or "Sail" Embodiment

Variations on the Sound Sail embodiment are depicted in FIGS. 9-11 and 19-23. The following description generally applies to the Sound Sail embodiment, including the depicted variations.

The Sound Sail embodiment uses a membrane comprised of a relatively lightweight and flexible surface, curved in one axis, reinforced with at least one rod-like member that serves to stiffen the panel and couple the membrane to the actuator. The preferred membrane material is a natural paper panel, optionally treated with a protective penetrant or coating, or a stiffened woven fabric. Suitable papers include 140 lb. 100% cotton rag watercolor paper (e.g. Arches brand) and "Saa" paper handmade from mulberry bark (typically from Thailand). Preferred fabrics include dupioni silk saturated with resin such as shellac or plasticized epoxy. Other known speaker membrane materials are also suitable.

Boundary conditions at the edges of the membrane have a significant effect on the overall vibration and harmonic properties of the panel. The current invention includes a number of boundary treatments to improve sound quality, durability and aesthetics of the complete panel. One method is to stiffen the edges with a flexible frame laminated or alternately adhered to the perimeter of the membrane. This frame can be made of the same material as the membrane or a contrasting material of similar weight for visual appeal. Another method involves selectively molding, forming, bending, folding, corrugating, rolling, pressing, heating, crimping or other known stiffening techniques to the edges of the panel in order to modify its stiffness at the perimeter. Edges may be folded back onto the panel and adhered to it, to create a framed construction made from a single piece of material. A third method involves increasing the internal diffusion characteristics by laser cutting a complex edge or cutting a series of slots near the edge.

In general, all of the above boundary treatments are similar to a two-dimensional analogy of common room acoustic treatments for flutter echoes, standing waves, and excessive reverberation in three-dimensional spaces such as recording studios or traditional loudspeaker enclosures.

While nominally rectangular and other shaped membranes can work, the preferred Sound Sail embodiment improves upon them by utilizing membrane shapes that vary in width (width being the axis perpendicular to the actuation axis of the rod.) Isosceles trapezoids, ovals, truncated ovals ("shields") and circles are examples of such shapes. In one of the preferred embodiments, an isosceles trapezoid modified with a slight convex curve to one or both of the parallel edges is used.

Specific examples of the decorative potential of this invention, also include membranes any type of shape, including shapes that resemble natural objects such as plant leaves, and shapes that resemble musical instruments such as guitar or violin bodies, and character shapes.

The preferred rod for this embodiment consists of approximately 5 mm diameter bamboo, fiberglass, or 3 mm pultruded carbon fiber composite. However, any diameter can be utilized when matched with a proper sized actuator. The preferred material and properties of a rod is long, ideally continuous, fibers that run longitudinal to the rod's length. Spring steel music wire is another suitable rod material. Although any rod material can be utilized, the rod properties listed above produce the best sound quality.

One of the key advantages of the anisotropic panel over prior art is that the speed of sound through the rod, and hence along the actuation axis, is significantly higher (~5×) than the speed of sound in air. In essence, this means that the membrane is caused to vibrate more uniformly despite being flexible.

Specifically, the flexural bending wave in the rod has a wavelength longer than the wavelength of the transverse sound wave created in the membrane. Thus the sound wavefront emanating from the surface of the panel has a higher degree of phase and spatial coherence. This reduces cancellation (comb filtering) as the wavefront diffuses through the air, and enhances low frequency performance. Another novel aspect of this invention is that the sound emits bi-directionally from both the front and back side of the membrane.

The material and configuration of the rod may also be considered as an analogy to optical fiber, where energy is preserved by internal reflection throughout the straight section of the rod, and then released to the membrane in the curved section(s) of the rod.

The above two factors, acting alone or in combination, are believed to provide an improvement in broadband sound quality, phase coherence, spatial imaging and frequency response. This is particularly evident comparing this invention to other panel based transducers that are actuated normal to the surface (sometimes referred to as Distributed Mode Transducers in prior art), and it has also been shown to improve upon the performance of other edge-driven curved panel sound generators.

In the simplest configuration a single rod, round or rectangular, approximately ¼" in cross section, running down the approximate center axis of the longest dimension of the membrane, is used.

The rod can be secured to the membrane in many ways. The rod can be securely adhered to the full length of the membrane on its longest axis. PVA, casein, or other resilient adhesive are appropriate. The rod can also be split and then attached or clamped around the center of the membrane. Two or more membranes can be attached around a rod with glue or other known attachment means. The rod extends a few inches beyond the membrane to facilitate coupling to the actuator(s) and/or rigid supports at both ends.

Other configurations, including multiple rods coupled to multiple actuators, branching rods that conduct vibration across the width as well as the length of the membrane, rods that do not extend the full length of the membrane and thereby allow part of the membrane to vibrate more freely at higher frequencies, are also incorporated in the scope of this improved design.

The present teachings also contemplate unibody or monocoque panel construction where the membrane and rod(s) are formed together in one process, from the same material (e.g. by molding or adding a thick section to a sheet of paper during the paper making process). Alternatively, additional high-modulus rod material (such as carbon tow) is embedded in the membrane material during manufacture. In some cases, different membrane materials can be combined together to produce different sonic or visual characteristics. It is recognized that many known acoustical materials and techniques can be applied to creating, forming and adhering a membrane to a rod remember.

A special and unique advantage of the hybrid membrane/rod panel is that the rod may be extended beyond the edge of the panel for a significant distance. The rod may be considered as an approximate analogy to optical fiber, where energy is preserved by internal reflection throughout the straight section of the rod, and then released to the membrane in the curved section(s) of the rod. As long as the portion of the rod that is not in contact with the membrane is nominally straight, then the majority of the acoustical energy is contained within it as longitudinal waves, and only released when it bends with the membrane.

Thus, the present teachings contemplate hanging lamps that function also as speakers, elegant floor-standing designs, and lightweight hanging structures (e.g. a design resembling a Calder mobile) may be built to provide not only visual appeal and utility but also quality sound output. Many other form factors are possible.

In these variations of the present teachings, the actuator and optionally all associated drive electronics (amplifier, power supply, signal processing, wireless audio receiver, etc.) may be housed in an enclosure that closely resembles, and is mechanically and electrically compatible with, existing infrastructure such as standard wall and ceiling electrical boxes, light sockets, and track lighting components. The actuator and optionally electronics may also be housed in a small enclosure directly attached to and supported by the panel, to create a fully self-contained free hanging speaker/lamp hung from a flexible cable.

EXAMPLE 2

"Sound Spiral" or "Spiral" Embodiment

Variations of the Sound Spiral embodiment are depicted in FIGS. 12-18 and described below. This embodiment incorporates the advantages and techniques of the Sound Sail configuration, with the following key differences and improvements.

In this embodiment, the design employs a pleated membrane, formed with an asymmetrical pattern of creases, alternating in direction (known as mountain and valley folds in the art of origami). The creases are arranged such that the folding and pleating of the material causes the membrane to assume a polygonal approximation of a compound curve. The preferred embodiment uses alternating diagonal and perpendicular creases, causing the pleated panel to approximate a helical surface. Like origami, countless form factors are possible for the membrane shape.

In this specific configuration, the folds in the membrane provide multiple improvements. Folds act as hinges, subdividing the membrane into multiple sub-panel radiators with a greater degree of independent movement freedom. This has been shown to increase high-frequency response and reduce large scale audible resonances at lower frequencies. Folds also act as lateral stiffeners, making the membrane more self-supporting and less sensitive to boundary conditions. Folding and pleating allows for a variety of compound curvature shapes to be made such as helical surfaces, hyperbolic paraboloids, and other shapes that would be difficult to form from flat sheets of material stock. The pleated panel may be folded flat for efficient packaging, storage and shipping.

The Spiral embodiment further incorporates a non-uniform spacing of the creases, in order to provide a sequence of faces of varying size. This further reduces dominant resonances and allows for greater freedom to create appealing and/or practical sculptural shapes. In particular, a crease pattern that in more closely spaces at the ends and wider in the middle, results in greater high frequency output at the extremes of the panel, improving stereo imaging.

The creases do not have to be straight. Slightly curved creases create polygons that are non-planar, and hence form sub panels of the overall curved membrane that are themselves curved. One could imagine any vertical or horizontal window styled blinds which when extended could generate sound, whereby the length of the extension could alter the tone of the sound. Such that a speaker and another existing item (window or privacy blinds) have combined function, providing more efficient use of living space.

In the Spiral embodiment two rods are attached to the membrane with a previously described technique, one at each of the non-pleated edges, extending the entire length of the edge. These two rods are preferably driven by two actuators, allowing for stereo sound from a single membrane radiator, or the two actuators may be driven from a single audio source (e.g., where the input signal is a mono signal) for greater output and more uniform dispersion. In still other cases, one rod may be coupled to an actuator, and the second rod may be a passive rod (i.e., not coupled directly to an actuator) configured to provide primarily structural support to the membrane, but not to cause vibration.

It is important to note that in the Spiral embodiment, the actuation axis remains perpendicular to the surface normal as in the Sail (both are edge-driven). However, the orientation of the actuation axis and rod in the Spiral is parallel to the edge of the panel, rather than perpendicular to the edge of the panel as in the Sail.

A variation in this embodiment incorporates rods and drivers aligned with specific pleats along the length of the folded membrane. This may be done instead of, or in addition to, rods and actuators placed at the ends. This variation permits construction of acoustic transducers of arbitrary length (e.g., a linear column from floor to ceiling, or a circular formation above a large conference table or seating area.). Arbitrary length and shape may also be achieved by modular construction, using prefabricated panels that can be mounted/coupled together to form the desired installation.

The inherent stiffening effect of the pleats also improves the potential for a unibody construction where the rods are formed from tightly folded or rolled sections of the membrane, fused into a stiff rod by adhesive, or water and pressure sufficient to cause the membrane to bond to itself, or other methods.

EXAMPLE 3

Common Features and Additional Refinements

This example describes features and refinements that may be used in some or all embodiments according to aspects of the present teachings.

Piezoelectric actuators are often used in edge-driven flextensional transducers. This has its origins in ultrasonic transducers and sonic warning devices (buzzers, industrial machinery alerts) where piezo devices excel. However, their poor low frequency response limits the performance of an edge-driven curved panel transducer intended for music, cinema, or any application where reproducing the full bandwidth of human hearing is desired. Therefore, embodiments of the present teachings may use voice-coil actuators, or magnetostrictive actuators.

Voice coil actuators typically have a tight-tolerance gap between the coil and the magnet/pole piece structure. Misalignment of the coil and the gap can cause contact between the coil and magnet or pole piece, leading to distortion, reduced response, and premature failure of the actuator. In the hybrid panel, edge-driven application described here, alignment of the actuator vibration axis to the central axis of the panel rod is crucial for actuator protection and also for optimal audio quality.

Traditional pistonic loudspeakers with voice coils and cone-shaped diaphragms are held in alignment by two elements, called the spider and surround. Both act as springs that are axially compliant and radially stiff. Thus they allow desirable movement in the actuation axis X, and minimize undesirable movement in the other two axes Y and Z.

Readily available, diaphragm-less voice coil transducers designed for surface-normal application, often called "tactile transducers" or "vibration speakers", include a spider but have no surround. The spider alone is insufficient to prevent Z-axis misalignment, especially when a long rod is attached. Therefore, embodiments according to the present teachings may use a secondary support method for the rod, to maintain axial alignment between the rod and the actuator while minimizing loss of acoustic energy.

One approach to secondary alignment of the rod is a second spider, i.e. an additional circular corrugated spring mounted preferably at a distance of 1-2" from the actuator's integral spider. Another approach is a spiral disc spring, made of metal or plastic, comprised of a thin disc with spiral slots. The slots form spiral arms that act as cantilevers that provide axial compliance and radial stiffness.

A preferred premium improvement to a second mechanical alignment device is a ring-shaped magnetic bearing assembly, which provides less mechanical resistance to movement along the actuation axis.

Because of the rod's small diameter compared to a traditional loudspeaker cone, a resilient ring such as a vinyl grommet or an o-ring, that acts similar to the surround on a cone diaphragm, may be employed at very low cost.

The above approaches also inherently limit the maximum excursion (Xmax) of the voice coil, providing additional protection against failure modes. Such failure modes include the voice coil leaving the gap, the voice coil bottoming out in the magnet/pole-piece structure, and stressing the spider beyond its tensile limits.

Depending on the orientation of the overall transducer with respect to gravity, and also depending on the stiffness of the curved rod, significant static force may be applied to the actuation that tends to force the coil away from its optimal rest position. This invention includes specific modification of the YZ axis alignment aids described above, in order to offset the static X axis forces of gravity and panel spring-back. This improves linearity and efficiency of the assembly, as well as robustness.

In some embodiments, an axially magnetized ring magnet is placed around the rod, with clearance so that the ring magnet does not contact the rod. An additional similar magnet with a smaller inner diameter is secured to the rod, oriented to provide appropriate repulsion or attraction as needed to counteract gravity and spring back forces.

In the above mechanisms that employ magnets as springs, the nonlinear spring force of typical magnets may be improved by using multipole magnet configurations, e.g. CMR Polymagnets, While it is possible to attach the rod to a prefabricated voice coil actuator, the rod itself may comprise an integral part of a voice-coil driven linear motor. In this embodiment, the linear motor may be either a moving-coil or moving-magnet motor. For a transducer with removable/replaceable panels, the moving-magnet configuration is advantageous, because no electrical connections are required to the panel. Furthermore, a magnet is already the preferred method for coupling a replaceable panel to the actuator, so cost and complexity savings may be achieved by using the same magnet for attachment and for actuation.

The integrated actuation approach described above can also be implemented using magnetostrictive transducers.

The form factor of the linear motor approach is a longer cylinder with smaller diameter, compared to a loudspeaker voice coil that is typically a short cylinder with large diameter. This may facilitate integration of two opposing-force actuator coils, or single magnetostrictive rod with its inherent push-push behavior, inside the rod assembly, within the length of the rod that is secured to the membrane, thereby eliminating entirely the bulk of an actuator attached to the end of the rod. This is particularly relevant for a free-hanging, elegant fixture, with nearly invisible drive mechanism. In this configuration, the rod becomes a variable length member that interacts with the membrane in a bimorphic manner.

The integrated actuator/rod configuration of the invention is also suited for application to other diaphragm geometries, in addition to the curved panel and pleated spiral designs discussed elsewhere in this document. These include configurations where the rod is bent into an oval or circular shape, that may be a fully closed or partially closed curve. This configuration is well-suited for sonic actuation of traditional lamp shade shapes, such as a truncated cone or a cylinder. Typical lampshades of this style have a stiffening member at the top and/or bottom edges of the shade. Often this member is a circular rod made of metal wire or other material. By replacing one or both of these circular rods with actuated rod(s) as described in this section, an embodiment may be created that is nearly identical in appearance to a simple lampshade, with no obvious additional transducers attached, and yet it functions as a loudspeaker as well as a lampshade or decorative object.

An additional embodiment of the integrated actuator/rod configuration is comprised of multiple segments of rod with multiple linear actuators, combined to form a contiguous linear piece with transducer elements spaced at intervals along its length.

In one embodiment of the multiple segment, multiple actuator configuration of the invention, all actuators are driven from a single audio power amplifier. The actuators may be wired in series, parallel, or a series-parallel arrangement as needed to match the power output and impedance characteristics of the amplifier. The result is that longitudinal actuation of the rod is distributed along its length, reducing the wave propagation delays along the full extent of the rod.

In another embodiment of the multiple segment, multiple actuator configuration of the invention, the actuators are divided into subgroups that are wired together, and each subgroup is driven by a separate amplifier channel. In this configuration the number of actuators is greater than the number of amplifiers, reducing the complexity of the amplifier design while retaining advantages of distributed actuation along the length of a rod.

In yet another embodiment of the multiple segment, multiple actuator configuration of the invention, the actuators are each driven independently by distinct amplifier channels, one amplifier per actuator. The multiple amplifiers are in turn driven by separate output channels from an audio signal processor. This allows for the application of multichannel signal processing algorithms to alter the electroacoustic response of the overall assembly is desirable ways. A variety of applicable algorithms may be employed to improve, enhance, or otherwise alter the radiation characteristics and subjective sound quality. Some algorithms are described in the following paragraphs. Within the scope of this invention such algorithms may be employed separately or in combination.

Filters analogous to crossover networks, as used in loudspeakers that are comprised of multiple drivers each optimized for a part of the audible frequency spectrum may be employed to drive various lengths of the rod and diaphragm with appropriately varied frequency ranges. A section of the multiple segment rod may be considered the "tweeter" and driven by the high frequency content of the audio source signal. Simultaneously, multiple segments, constituting a longer length of the rod assembly, may be driven together as a "woofer" with lower frequency content. In a preferred embodiment the mapping of frequency bands to rod segments overlaps, in a manner similar to concentric loudspeakers where the tweeter is mounted near the acoustical center of the woofer.

Phase linearization and stabilization algorithms may also be used. For example, a low frequency signal may be applied to the actuators at the outer ends of the rod assembly, while phase-shifted instances of the same signal are applied to actuators at other positions on the segmented rod. The amount of phase shift take into account the speed of sound in the particular rod material, as well as the lengths of the rod segments involved, resulting in a more coherent and stable phase response with improved transient response.

Active damping of undesirable vibration modes of the rod and panel assembly may be introduced. In section 3.2.5.3.1 above, the center segment of the multiple segment rod may be considered the "tweeter", that is the primary high-frequency radiator. However the energy applied to the center segment will also travel outward along the rod, incidentally actuating the outer extents of the rod and panel. The resulting would be a less predictable response characteristic than that provided by a physically distinct, isolated tweeter element with a rigid boundary. By applying suitably phase-shifted and filtered instances of the high-frequency content to actuators positioned further out toward the ends of the rod, some of this undesired actuation may be reduced.

Another example of active mode control may be considered analogous to echo cancellation. An actuator at the end of a rod generates a longitudinal wave that travels along the length of the rod. This wave is then reflected, to some extent, at the far end of rod, and travels back towards the actuated end of the rod. This results in frequency resonances at wavelengths related to the rod length, and smearing of transients in the time domain. An actuator at the far end of the rod may be employed to introduce a cancellation signal to mitigate these reflections. Any or all actuators may be used to inject both desired signal components, and cancellation signals for unwanted reflections of signals from the same or other actuators.

Other algorithms derived from prior art in loudspeaker directionality and pattern control, and phased-array beam forming may also be applied, to optimize the spatial coverage of the current invention to its environment. This may be extended under the scope of this invention to include closed-loop adjustments, where one or more microphones are used to measure the performance of the transducer in interaction with a given environment, and the measurement data is subsequently used to guide automated or partially automated adjustment of amplitude, phase, and directivity parameters across the frequency spectrum.

EXAMPLE 4

Additional General Features

This example provides additional details about various aspects of the present teachings that may be novel in the field of acoustic transducers.

According to the present teachings, an edge-driven diaphragm may have anisotropic (nonuniform) elasticity. Specifically, a diaphragm with elastic moduli that are maximized along the actuation axis, and reduced in other directions. The novelty of this design feature refers to energy propagation within the diaphragm itself, as distinct from the general flextensional behavior of edge-driven curved panel acoustic transducers.

The material(s) and structure of the panel are configured so that the speed of sound, longitudinally within the panel along an actuation axis, is substantially greater than the speed of sound in air. Therefore at a given frequency the primary flexural bending wavelength in the panel is substantially greater than the corresponding wavelength in air. Particularly for low-frequency wavelengths exceeding the panel dimensions, this results in fewer ripples in the transverse vibration of the diaphragm, and hence a more uniformly projected wavefront of audible sound.

According to aspects of the present teachings, the speed of sound through the rod, and hence across the membrane, is significantly higher (~5×) than the speed of sound through the surrounding air. In this configuration the flexural bending wave in the plate has a wavelength much longer than the wavelength of the transverse sound wave created in the surrounding air. Thus the sound wavefront emanating from the surface of the panel has a higher degree of phase coherence. This reduces phase cancellation (comb filtering) as the wavefront diffuses through the air, and specifically enhances low frequency performance.

The present teachings also contemplate specific optimizations of the materials, structure, shape and curvature of the panel, which optimize spatial coherency in fundamental frequency ranges of interest to music and voice reproduction applications. This is an improvement over many forms of prior loudspeaker art, that often have undesirable sound coloration due to panel or cabinet resonances, crossover phase distortion, and spatial lobes.

Furthermore, the design provides for focused conduction of acoustic energy, within the panel along an actuation axis, in a relatively linear and directional manner. A preferred embodiment of this improvement uses long unidirectional fibers such as bamboo, wood, fiberglass or pultruded carbon fiber composite.

Additionally, the membrane material and design is such that flexural bending waves in directions other than the actuation axis tend to decay or diffuse within the panel, approaching evanescent waves. This reduces boundary reflections, standing waves, and the Q factor of resonant peaks.

These effects are particularly relevant in musically important frequency ranges, helping to avoid panel resonances (coloration) that distract the listener's perception of natural resonances, e.g. vocal formants.

The absence of a cabinet and midrange crossover also helps with avoiding resonance coloration due to resonance and wavefront lobes in this key range, further enhancing the subjectively appealing spatial characteristics of the transducer.

The radiator (diaphragm) may be supported by the actuators so it may be suspended and used as a decorative sculpture and/or lampshade.

The actuator(s) may be housed in a support module that can be designed for tabletop use, wall or ceiling mounting.

Alternatively, the actuators may be secured to the panel itself, using suitable stiffening rods adhered to one or more pleats of the sound panel. In this embodiment, the panel may be hung from a cable and allowed to turn freely.

EXAMPLE 5

Additional Sound Spiral Features

This example provides additional details about various aspects of the Sound Spiral embodiments described above and depicted in FIGS. 12-18.

Variations on the pleating pattern to avoid uniform sizes and hence predominant resonant modes. Specifically, the following pattern: narrow pleats toward the edges, wider in the middle, actuated at multiple points near the edges so as to create an improved stereo sound field from a single panel.

A configuration where a spiral of arbitrary length is constructed from one or more long pieces of panel material, with multiple actuators spaced along the spiral.

The above where the actuators are separated from the pleats of the spiral by a rigid rod, so that the spiral can be suspended in space at a distance from the actuators.

A specific embodiment of the above where the actuators (and optionally their associated amplifier, signal source (e.g. wireless receiver, preamp or self-contained audio playback device) are installed in a housing that is compatible, mechanically and electrically, with track lighting fixtures A variation of the track lighting concept using a dedicated track, not used for lighting, that nevertheless supports modular and extensible lengths of spiral sound transducers to be configured as desired to suit a given installation space. For example, long hallways, curved shapes, and serpentine patterns.

EXAMPLE 6

Additional Plant-Like Aesthetic Features

This example provides additional details about configurations aesthetically resembling natural plants.

An acoustical transducer comprised of a curved panel formed and shaped to resemble a flower petal or plant leaf, actuated by vibrations conducted through the stem.

The above in a configuration where actual real plants (living or preserved) are used as the panel and/or stem.

The above in a configuration where one stem is attached to the actuator and one leaf is used as the sound radiator.

A configuration where one stem is attached to the actuator and multiple leaves are attached to the stem at various point along its length A configuration where multiple (e.g. 3) stems are attached to a single actuator, then branch out to resemble a cluster of plants/foliage A variation where the actuator is made smaller and placed at the junction of the leaf and stem.

EXAMPLE 7

Kite Embodiments

This example provides additional details about configurations that can function as both audio transducers and recreational kites.

A flying kite where some or all of the surface of the kite is actuated to create sound, e.g. music or appropriate flying sound effects such as Doppler shifts, bird calls or airplane sounds.

An embodiment where the actuators are placed on the kite itself along with a sound source and power source.

An embodiment where sensors such as accelerometers, wind speed sensors, inertial sensors, IR horizon sensors, or optical sensors) are employed to trigger and/or modify the audio reproduction emanating from the kite.

An embodiment where, for size and weight considerations, the actuators and associated electronics are ground based, and the vibration energy is transmitted along the kite string(s).

An embodiment where the actuators are located on the kite itself, and power and/or audio signals are transmitted from the ground along conductive elements in the kite strings (e.g. using wire for kite strings).

EXAMPLE 8

Book Embodiments

This example provides additional details about configurations that can function as both audio transducers and books.

A book with multiple pages, using traditional paper or other suitable material for the pages such as plastic, with audio actuators embedded in the binding of the book. The edge-driven curved panel technology causes sound to emanate from the pages that the book is opened to.

An embodiment with touch sensors on the pages, comprised of printed conductive ink used for capacitive or resistive sensing matrices, or separately manufactured touch sensors attached to the pages, so that the reader/user can control playback of audio by touching specific areas of specific pages. For example, a word in a foreign language could be pronounced by touching it in an educational application. Music samples from a performer or sound effects from a film could be heard by touching an image of the performance or film.

EXAMPLE 9

Image Projection Screen Embodiments

This example provides additional details about configurations that can function as both audio transducers and image projection screens.

A curved panel, edge driven screen where the panel is made from a material suitable for image projection screen use. This could include opaque reflective material such as paper, coated plastic, or fabric. The anisotropic improvements of the current invention can specifically improve channel separation and spatial imaging where multiple rods and actuators are employed.

EXAMPLE 10

Architectural Embodiments

This example provides additional details about configurations that can function as both audio transducers and architectural features.

Application of the improvements of the present invention to portable or permanent canopies such as sun shades, awnings, deck chairs with attached sun shades, patio umbrellas, hand held parasols, tents, and so forth.

EXAMPLE 11

Numbered Paragraphs

The following paragraphs may further define or describe aspects of the present teachings, and may be combined with each other and/or with other aspects of this disclosure without limitation.

A. An acoustic transducer, comprising:

a flexible membrane;

an elongate rod rigidly attached to the membrane; and an electromotive actuator rigidly coupled to the rod and configured to cause longitudinal vibrations of the rod corresponding to an audio signal;

wherein the longitudinal vibrations of the rod are converted at least partially into transverse flexural vibrations of the membrane to produce audible sound corresponding to the audio signal.

A1. The transducer of claim A, further comprising a light source and wherein the membrane is configured to shade the light source.

A2. The transducer of claim A, wherein the actuator is contained within an enclosure and wherein the enclosure includes an aperture allowing the actuator to be coupled to the rod through the aperture.

A3. The transducer of claim A2, further comprising an axial stabilizer disposed within the aperture and configured to reduce radial forces on the actuator.

A4. The transducer of claim A3, further comprising a coupler attached to the actuator, extending through the aperture and configured to couple the actuator to the rod.

A5. The transducer of claim A4, wherein the coupler includes a magnet configured to exert an attractive force on a magnet of the rod thereby coupling the actuator to the rod.

A6. The transducer of claim A, wherein the membrane is curved along at least one axis, and wherein curvature of the membrane is caused by attachment of the membrane to the rod.

B. A system for producing stereo audio output, comprising:

first and second actuators configured to receive first and second channels of an audio input signal;

first and second elongate rods each coupled to one of the actuators and configured to vibrate in response to vibrations of the corresponding actuator; and first and second membranes each coupled to one of the rods and configured to vibrate in response to vibrations of the corresponding rod and thus to produce audible sound corresponding to the corresponding channel of the audio input signal.

B1. The system of claim B, wherein each rod is coupled to one of the actuators through a coupler including an elongate member protruding from the actuator and a magnet attached to a distal end of the elongate member and configured to exert an attractive force on a magnet disposed at one end of the rod.

B2. The system of claim B, wherein each actuator is contained within an enclosure and wherein each enclosure includes an aperture allowing the actuator to be coupled to the corresponding rod through the aperture.

B3. The system of claim B2, further comprising an axial stabilizer disposed within each aperture and configured to reduce radial forces on the corresponding actuator.

B4. The system of claim B, wherein each membrane is curved along at least one axis, and wherein curvature of the membranes is caused by attachment of the membrane to the corresponding rod at two separated positions.

C. A system for producing stereo audio output, comprising:

a first actuator configured to receive a first audio input signal;

a first elongate rod coupled to the first actuator and configured to vibrate in response to vibrations of the first actuator; and a membrane coupled to the first rod and configured to vibrate in response to vibrations of the first rod and thus to produce audible sound corresponding to the first audio input signal.

C1. The system of claim C, wherein the rod is configured to vibrate longitudinally and the membrane is configured to vibrate transversely.

C2. The system of claim C, further comprising a second elongate rod, wherein the first audio input signal is a mono audio signal, and wherein the membrane is coupled to the second rod.

C3. The system of claim C2, wherein the second rod is a passive rod configured to provide structural support to the membrane.

C4. The system of claim C2, further comprising a second actuator configured to receive the mono audio signal, wherein the second rod is coupled to the second actuator and configured to vibrate in response to vibrations of the mono audio signal.

C5. The system of claim C, wherein the first audio signal is a first channel of a stereo audio signal, and further comprising:

a second actuator configured to receive a second audio input signal which is a second channel of the stereo audio signal; and a second elongate rod coupled to the second actuator and configured to vibrate in response to vibrations of the second actuator;

wherein the membrane is further coupled to the second rod and configured to vibrate in response to vibrations of the second rod and thus to produce audible sound corresponding to the first and second channels of the stereo audio signal.

C6. The system of claim C5, wherein each rod is coupled to one of the actuators through a coupler including an elongate member protruding from the actuator and a magnet attached to a distal end of the elongate member and configured to exert an attractive force on a magnet disposed at one end of the rod.

C7. The system of claim C6, wherein each actuator is contained within an enclosure, each enclosure includes an aperture allowing the actuator to be coupled to the corresponding rod through the aperture, and further comprising an axial stabilizer disposed within each aperture and configured to reduce radial forces on the corresponding actuator.

What is claimed is:

1. An acoustic transducer, comprising:

a flexible pleated membrane configured in a spiral shape;

first and second elongate rods rigidly attached to the membrane;

a first electromotive actuator rigidly coupled to the first rod and configured to cause longitudinal vibrations of the first rod corresponding to an audio signal;

wherein the longitudinal vibrations of the first rod are converted at least partially into transverse flexural vibrations of the membrane to produce audible sound corresponding to the audio signal; and a second electromotive actuator;

wherein the first and second actuators are coupled to opposing ends of the first rod and the second electromotive actuator is configured to cause longitudinal vibrations of the first rod corresponding to a second audio signal; and wherein signal processing is applied separately to the first and second audio signals.

2. The transducer of claim 1, further comprising a light source and wherein the membrane is configured to shade the light source.

3. The transducer of claim 1, wherein the first actuator is contained within an enclosure and wherein the enclosure includes an aperture allowing the first actuator to be coupled to the first rod through the aperture.

4. The transducer of claim 3, further comprising a coupler attached to the first actuator, extending through the aperture and configured to couple the first actuator to the first rod.

5. The transducer of claim 4, wherein the coupler includes a magnet configured to exert an attractive force on a magnet of the first rod thereby coupling the first actuator to the first rod.

6. The transducer of claim 1, wherein the actuators are separated from the membrane by the rods such that the membrane may be suspended in space at a distance from the actuators.

7. The transducer of claim 1, wherein the membrane is transitionable to a flat folded state.

8. The transducer of claim 1, wherein edges of the membrane are stiffened.

9. The transducer of claim 1, wherein the signal processing includes frequency-dependent phase shifts between the first and second audio signals configured to reduce internal reflections in the membrane.

10. An acoustic transducer, comprising:

a flexible pleated membrane configured in a spiral shape;

first and second elongate rods rigidly attached to the membrane;

an electromotive actuator rigidly coupled to the first rod and configured to cause longitudinal vibrations of the first rod corresponding to an audio signal;

wherein the longitudinal vibrations of the first rod are converted at least partially into transverse flexural vibrations of the membrane to produce audible sound corresponding to the audio signal;

wherein the actuator is contained within an enclosure and wherein the enclosure includes an aperture allowing the actuator to be coupled to the first rod through the aperture;

further comprising a coupler attached to the actuator, extending through the aperture and configured to couple the actuator to the first rod;

wherein the coupler is a sensing coupler including a sensor capable of distinguishing between different varieties of membrane, and further including a digital signal processor configured to load one or more settings according to the variety of membrane detected by the sensing coupler.

11. The transducer of claim 10, further comprising a light source and wherein the membrane is configured to shade the light source.

12. The transducer of claim 10, wherein the coupler includes a magnet configured to exert an attractive force on a magnet of the first rod thereby coupling the actuator to the first rod.

13. The transducer of claim 10, wherein the membrane is transitionable to a flat folded state.

14. The transducer of claim 10, wherein edges of the membrane are stiffened.

* * * * *